US010737281B2

(12) United States Patent
Liu et al.

(10) Patent No.: US 10,737,281 B2
(45) Date of Patent: Aug. 11, 2020

(54) COMPOSITIONS AND METHODS FOR REVERSE FROTH FLOTATION OF PHOSPHATE ORES

(71) Applicant: Ecolab USA Inc., St. Paul, MN (US)

(72) Inventors: Jianjun Liu, Aurora, IL (US); Suresh R. Sriram, Aurora, IL (US); Kevin O'Brien, Saint Charles, IL (US); Daniel N.T. Hay, Naperville, IL (US)

(73) Assignee: Ecolab USA Inc., St. Paul, MN (US)

( * ) Notice: Subject to any disclaimer, the term of this patent is extended or adjusted under 35 U.S.C. 154(b) by 257 days.

(21) Appl. No.: 15/989,283

(22) Filed: May 25, 2018

(65) Prior Publication Data

US 2018/0345297 A1 Dec. 6, 2018

Related U.S. Application Data

(60) Provisional application No. 62/512,278, filed on May 30, 2017.

(51) Int. Cl.
*B03D 1/012* (2006.01)
*B03D 1/02* (2006.01)
*B03D 1/008* (2006.01)

(52) U.S. Cl.
CPC ..... *B03D 1/021* (2013.01); *B03D 1/008* (2013.01); *B03D 1/012* (2013.01);
(Continued)

(58) Field of Classification Search
CPC ..... B03D 1/021; B03D 1/008; B03D 1/012; B03D 2203/06; B03D 2201/02; B03D 2201/06
(Continued)

(56) References Cited

U.S. PATENT DOCUMENTS 1,926,442 A 9/1933 Gunther et al.
2,069,182 A 1/1937 Johnson
(Continued)

FOREIGN PATENT DOCUMENTS

CN 101020159 A 8/2007
CN 106269277 A 1/2017
(Continued)

OTHER PUBLICATIONS

Srdjan M. Bulatovic, Handbook of Flotation Reagents, "Collectors", vol. 1, Chapter 2, 37 pages. 1995.
(Continued)

*Primary Examiner* — Thomas M Lithgow
(74) *Attorney, Agent, or Firm* — Kagan Binder, PLLC

(57) ABSTRACT

Improved sparge compositions for reverse froth flotation separation and uses thereof, and improved methods of reverse froth flotation are described. Described are sparge compositions comprising collectors and beneficiating agents, the collectors comprising sulfonated fatty acids and/or salts thereof, and the beneficiating agents comprising a hydroxy fatty acid composition. The sparge compositions are suitably used in the reverse froth flotation to separate phosphate beneficiary from ores comprising phosphate and dolomite, calcite, silicate, and/or other gangues. The disclosed compositions and methods exhibit improved separation of phosphate from such ores.

20 Claims, 8 Drawing Sheets

(52) U.S. Cl.
CPC .... *B03D 2201/007* (2013.01); *B03D 2201/02* (2013.01); *B03D 2201/06* (2013.01); *B03D 2203/06* (2013.01)

(58) Field of Classification Search
USPC ..... 209/166; 252/61
See application file for complete search history.

(56) References Cited

U.S. PATENT DOCUMENTS

| | | | | |
|---|---|---|---|---|
| 3,164,549 | A | 1/1965 | Seymour | |
| 4,147,644 | A | 4/1979 | Wang et al. | |
| 4,172,029 | A | 10/1979 | Hefner, Jr. | |
| 4,287,053 | A | 9/1981 | Lehr et al. | |
| 4,289,613 | A | 9/1981 | Goodman et al. | |
| 4,360,425 | A | 11/1982 | Lim et al. | |
| 4,364,824 | A * | 12/1982 | Snow | B03D 1/012 209/167 |
| 4,368,116 | A | 1/1983 | Petrovich | |
| 4,372,843 | A | 2/1983 | Lawver et al. | |
| 4,421,641 | A | 12/1983 | Blazy et al. | |
| 4,436,616 | A | 3/1984 | Defour et al. | |
| 4,486,301 | A | 12/1984 | Hsieh et al. | |
| 4,514,292 | A | 4/1985 | Burdick | |
| 4,552,652 | A | 11/1985 | Attia et al. | |
| 4,565,625 | A | 1/1986 | Hsieh et al. | |
| 4,568,454 | A * | 2/1986 | Mehrotra | B03D 1/021 209/167 |
| 4,588,498 | A | 5/1986 | Mair et al. | |
| 4,600,505 | A | 7/1986 | Mair et al. | |
| 4,636,303 | A | 1/1987 | Hsieh | |
| 4,719,009 | A | 1/1988 | Furey et al. | |
| 4,720,339 | A | 1/1988 | Nagaraj et al. | |
| 5,171,427 | A | 12/1992 | Klimpel et al. | |
| 5,314,073 | A | 5/1994 | Sharma et al. | |
| 5,441,156 | A * | 8/1995 | Fabry | B03D 1/012 209/166 |
| 5,507,395 | A | 4/1996 | Wang et al. | |
| 5,525,212 | A | 6/1996 | Nagari et al. | |
| 5,531,330 | A | 7/1996 | Nagaraj et al. | |
| 5,533,626 | A | 7/1996 | Nagaraj et al. | |
| 5,542,545 | A * | 8/1996 | Yu | B03D 1/021 209/166 |
| 5,551,640 | A | 9/1996 | Rajchel | |
| 5,919,975 | A | 7/1999 | Rasheed | |
| 5,929,408 | A | 7/1999 | Gutierrez et al. | |
| 6,133,474 | A | 10/2000 | Rasheed et al. | |
| 6,149,013 | A | 11/2000 | Hughes | |
| 6,536,595 | B2 | 3/2003 | Kowalski et al. | |
| 7,560,578 | B2 | 7/2009 | Ahmad et al. | |
| 7,922,788 | B2 | 4/2011 | Hillier et al. | |
| 8,221,709 | B2 | 7/2012 | Gargulak et al. | |
| 8,720,694 | B2 | 5/2014 | Nagaraj et al. | |
| 10,434,520 | B2 * | 10/2019 | Gu | C01B 25/425 |
| 2006/0183879 | A1 | 8/2006 | Yamato et al. | |
| 2014/0144815 | A1 | 5/2014 | Liu et al. | |
| 2014/0298872 | A1 | 10/2014 | Gill et al. | |
| 2015/0196926 | A1 | 7/2015 | Moreire Da Costa et al. | |

FOREIGN PATENT DOCUMENTS

| | | | |
|---|---|---|---|
| GB | 498450 | A | 1/1939 |
| SU | 1514409 | | 10/1989 |
| WO | 2002089991 | A2 | 11/2002 |
| WO | 2016109254 | A1 | 7/2016 |
| WO | 20180197476 | A1 | 11/2018 |
| ZA | 199601987 | | 3/1996 |

OTHER PUBLICATIONS

Standard Test Method for Sieve Analysis of Fine and Coarse Aggregates, ASTM International, Designation: C 136-05, pp. 88-92. 2004.

Shouci Lu and Keji Sun, "Developments of Phosphate Flotation Reagents in China," Society for Mining, Metallurgy, and Exploration, (1999), pp. 21-26.

Zhang P et al., "Evaluation of phosphate depressants in the phosphate/dolomite system," 27th International Mineral Processing Congress, Industrial and Phosphate Research Institute, US (2014) pp. 1-10.

H. Sis et al., "Reagents used in the flotation of phosphate ores: a critical review," Minerals Engineering, vol. 16, No. 7, (2003), pp. 577-585.

Nagaraj et al., "Froth Flotation—A Century of Innovation," Society of Mining Metllurgym and Exploration, Inc., (2007), pp. 394-405.

William W. Christie, Fatty Acids: Hydroxy and Other Oxygenated Structures, Occurrence and Biochemistry, updated Oct. 29, 2013 via lipidlibrary.aocs.org, 8 pages.

Turrer et al., "Investigation on alternative depressants for iron ore flotation", Minerals Engineering, 23. (2003), pp. 1066-1069.

Kellogg et al., "Flotation of Kaolinite for Removal of Quartz", Ceramic Age, 46(1), Jun. 30, 1945, pp. 1-8.

Vijayaraghaven et al, "Beneficiation of Minerals in Reverse Flotation", Proceedings of National Seminar on Recent Techniques in Mineral Waste, Feb. 2, 2002, p. 82.

Papini et al., Cationic flotation of iron ores: amine characterization and performance, Minerals and Metallurgical Process, Society for Mining, Metallurgy and Exploration, 18(1), pp. 5-9. 2001.

AUROPOL 438, Revision 3, Victorian Chemical Company Pty. Limited, Dated: May 20, 2009, 2 pages.

International Search Report for International Application No. PCT/US2018/034606, dated Aug. 22, 2018, 6 pages.

Written Opinion for International Application No. PCT/US2018/034606, dated Aug. 22, 2018, 8 pages.

Norman C. Foster, "Sulfonation and Sulfation Processes", The Chemithon Corporation, 36 pages, Jan. 1, 1997.

* cited by examiner

COMPOSITIONS AND METHODS FOR REVERSE FROTH FLOTATION OF PHOSPHATE ORES

The present invention relates to improved methods, and compositions for froth flotation, in particular for separation of phosphate beneficiaries from mineral ores containing carbonate gangue.

BACKGROUND

The invention relates to novel materials, compositions, and methods for improving the effectiveness of froth flotation beneficiation processes. Many minerals and other materials are obtained from mining and other resource recovery operations as an intimate mixture that is difficult to separate into its constituents. For example, ores as mined are often multimineralic, and contain at least one desired component, a beneficiary, and one or more other less valuable and/or desirable materials, a gangue.

In a beneficiation process, two or more materials that coexist in a mixture are separated from each other to obtain a beneficiary in a more concentrated form than that which existed in the mixture. One form of beneficiation is froth flotation separation.

In froth flotation separation of a mineral ore, the ore is finely ground (comminuted) to form a comminuted ore in the form of a particulate. The comminuted ore is slurried in a liquid medium, typically water, to make a slurry that is a sparge composition. Other components that assist in the separation of beneficiary from gangue can be included in the sparge composition, components such as collectors, modifiers, depressants, frothers (frothing agents), and/or activators.

In a process known as sparging, a gas, typically air, is bubbled through the sparge composition, and a froth forms at the surface of the sparge composition. During sparging, some materials from the ore such as targeted particles are carried up with the gas bubbles (i.e. floated) and concentrate in the froth, whereas other materials concentrate in the body of the liquid, the underflow.

The role of a collector is to assist the flotation of targeted particles in the sparge composition. The role of a depressant is to hinder or prevent the flotation of untargeted particles in the sparge composition.

The sparge composition is sparged with the gas, bubbles of which rise up out of the slurry carrying hydrophobic particles therewith and form the froth layer above the underflow. The froth layer may then be deposited on a launder. The less hydrophobic material remains behind in the slurry, thereby accomplishing the froth flotation separation.

Two common forms of flotation separation processes are direct flotation and reverse flotation. In direct flotation processes the froth comprises the beneficiary or concentrate, while in reverse flotation processes the froth comprises gangue or tailings. The object of the flotation in both forms of froth flotation is to separate and recover as much as possible of the beneficiary from the particulate material in as high a concentration of that beneficiary as possible. In froth flotation, a sparge composition is sparged to form a froth layer and an underflow. In a direct froth flotation, the froth layer comprises a concentrated beneficiary (a concentrate), and the underflow comprises tailings (concentrated gangue). In reverse froth flotation, the froth layer comprises tailings and the underflow comprises a concentrated beneficiary. In direct froth flotation, the froth can comprise more beneficiary than gangue, and the tailings can comprise more gangue than beneficiary. In reverse froth flotation, the froth can comprise more gangue than beneficiary and the tailings can comprise more beneficiary than gangue.

Froth flotation separation can be used to separate solids from solids (such as the constituents of mine ore), and liquids or semi-solids from solids (such as the separation of bitumen from oil sands).

A prerequisite for flotation separation is the liberation of particles. For flotation of mineral ores, therefore, comminuting (grinding the solids up by such techniques as dry-grinding, wet-grinding, and the like) is required to liberate minerals. Extensive grinding or comminution can result in better liberation of particles for the separation of beneficiary and gangue in a froth flotation process.

Phosphate ores commonly comprise phosphate minerals and gangue impurities such as carbonate and silicate. One phosphate mineral is apatite, which comprises $PO_4^{3-}$ and $Ca^{2+}$. Apatites include hydroxyapatite (hydroxylapatite), fluorapatite, and chlorapatite, minerals which comprise in addition to phosphate anions other anions such as $F^-$, $Cl^-$, $OH^-$, and/or $CO_3^{2-}$. Among the impurities in phosphate ores are carbonates such as dolomite and/or calcite, silicates, and clays. Phosphate ores generally require beneficiation before they are used in any subsequent (downstream) processes such as phosphoric acid production. The presence of impurities in a phosphate ore, even after beneficiation, can cause considerable problems in such downstream operations. For example, presence of carbonate in a phosphate ore beneficiary can result in high sulfuric consumption and higher viscosity in phosphoric acid production from the phosphate beneficiary. Therefore, effective removal of carbonate from phosphate ore is essential for downstream phosphoric acid production from the phosphate of the ore. One of the common processes of carbonate removal is reverse froth flotation, where carbonate minerals are enriched in the froth as tailings while phosphate minerals are concentrated in the underflow.

Sulfonated fatty acids have been used since the 1980s as collectors in froth flotation beneficiation of phosphate ores. Sulfonated fatty acids have the advantage that they function as collectors over a wide range of pH, temperature and water hardness. Further, sulfonated fatty acids exhibit higher selectivity to targeted particles containing carbonate and/or silicate than non-sulfonated fatty acids. However, one disadvantage of sulfonated fatty acids when used in froth flotation is that they can cause excessive froth accompanied by reduced grade and/or recovery (yield) of beneficiary, and excessive froth can lead to downstream froth handling issues.

Although the object of froth flotation is to separate and recover as much as possible of the beneficiary in as high a concentration as possible, in such processes there is a compromise between purity of concentrate and yield of the beneficiary. Adjustment of froth flotation conditions and/or materials can produce an improvement of purity at the expense of yield or visa-versa.

In view of the above issues, it would be an advantage to provide for froth flotation improved methods and/or compositions that can be implemented in existing froth flotation installations for separation of beneficiary from ores. It would be an advantage to provide improved methods and materials therefor for obtaining better yields and better purity of beneficiaries. It would be an advantage to provide improved methods and/or compositions for froth flotation which do not cause excessive frothing during the froth flotation process accompanied by reduced grade and/or recovery (yield) of beneficiary and froth handling issues.

SUMMARY

Disclosed herein are sparge compositions for use in reverse froth flotation of phosphate ores. In embodiments, there is disclosed a sparge composition comprising (i) a medium; (ii) a comminuted phosphate ore; (iii) a collector comprising a sulfonated fatty acid composition, the sulfonated fatty acid composition comprising one or more sulfonated fatty acids, one or more sulfonated fatty acid salts, or any combination thereof; and (iv) a beneficiating agent comprising a hydroxy fatty acid composition, the hydroxy fatty acid composition comprising one or more hydroxy fatty acids, one or more hydroxy fatty acid salts, or a combination thereof, wherein the comminuted phosphate ore comprises a phosphate beneficiary and a gangue. In embodiments, the medium comprises, consists of, or consists essentially of water. In embodiments, the weight of the sulfonated fatty acid composition divided by the weight of the hydroxy fatty acid composition is about 0.01 to about 99. In some embodiments, the sparge composition has a pH of about 4 to about 7. In some embodiments, the one or more sulfonated fatty acids, the one or more sulfonated fatty acid salts, or the combination thereof comprises, consists of, or consists essentially of a sulfonated fatty acid, a sulfonated fatty acid salt, or a combination thereof. In some embodiments, the one or more hydroxy fatty acids, the one or more hydroxy fatty acid salts, or the combination thereof comprises, consists of, or consists essentially of a hydroxy fatty acid, a hydroxy fatty acid salt, or a combination thereof.

In embodiments, the hydroxy fatty acid composition comprises a C6 to C30 hydroxy fatty acid, a salt of a C6 to C30 hydroxy fatty acid, or a combination thereof.

In embodiments, the hydroxy fatty acid composition comprises a hydroxy fatty acid having from one to three hydroxyl groups, a salt of a hydroxy fatty acid having from one to three hydroxyl groups, or a combination thereof.

In embodiments, the hydroxy fatty acid composition comprises ricinoleic acid, a salt of ricinoleic acid, 12-hydroxystearic acid, a salt of 12-hydroxystearic acid, 9,10-dihydroxyoctadecanoic acid, a salt of 9,10-dihydroxyoctadecanoic acid, 9,10,18-trihydroxyoctadecanoic acid, a salt of 9,10,18-trihydroxyoctadecanoic acid, lesquerolic acid, a salt of lesquerolic acid, 15-hydroxyhexadecanoic acid, a salt of 15-hydroxyhexadecanoic acid, isoricinoleic acid, a salt of isoricinoleic acid, densipolic acid, a salt of densipolic acid, 14-hydroxy-eicosa-cis-11-cis-17-dienoic acid, a salt of 14-hydroxy-eicosa-cis-11-cis-17-dienoic acid, 2-hydroxyoleic acid, a salt of 2-hydroxyoleic acid, 2-hydroxylinoleic acid, a salt of 2-hydroxylinoleic acid, 18-hydroxystearic acid, a salt of 18-hydroxylinoleic acid, 15-hydroxylinoleic acid, a salt of 15-hydroxylinoleic acid, or any combination thereof.

In embodiments, the hydroxy fatty acid composition comprises ricinoleic acid, a salt of ricinoleic acid, or a combination thereof.

In embodiments, the hydroxy fatty acid composition comprises a hydroxy fatty acid derived from the hydrolysis of castor oil, a salt of a hydroxy fatty acid derived from the hydrolysis of castor oil, or a combination thereof.

In embodiments, the hydroxy fatty acid composition comprises an unsaturated hydroxy fatty acid having one double bond or two double bonds, a salt of an unsaturated hydroxy fatty acid having one double bond or two double bonds, or a combination thereof. In some such embodiments, the hydroxy fatty acid composition consists essentially of sodium ricinoleate, potassium ricinoleate, or a combination thereof.

In embodiments, the hydroxy fatty acid composition comprises a saturated hydroxy fatty acid, a salt of a saturated hydroxy fatty acid, or a combination thereof.

In embodiments, the gangue comprises a carbonate.

In embodiments, the gangue comprises calcite, dolomite, or a combination thereof.

In embodiments, the sulfonated fatty acid composition comprises sulfonated oleic acid, a sulfonated oleic acid salt, sulfonated linoleic acid, a sulfonated linoleic acid salt, sulfonated linolenic acid, a sulfonated linolenic acid salt, sulfonated ricinoleic acid, a sulfonated ricinoleic acid salt, sulfonated palmitoleic acid, a sulfonated palmitoleic acid salt, sulfonated 11-eicosenoic acid, a sulfonated 11-eicosenoic acid salt, sulfonated erucic acid, a sulfonated erucic acid salt, sulfonated nervonic acid, a sulfonated nervonic acid salt, or any combination thereof.

In embodiments, the comminuted phosphate ore comprises a comminuted apatite.

In embodiments, the sparge composition further comprises one or more emulsifying surfactants, one or more additional collectors, one or more depressants, one or more activators, one or more frothing agents, or any combination thereof.

In embodiments, the sparge composition comprises sodium tripolyphosphate or ammonium polyphosphate, or a combination thereof.

In embodiments, the sparge composition comprises a pH adjusting agent.

There is provided herein a method of reverse froth flotation comprising sparging any of one of the sparge compositions disclosed herein. In embodiments, the method further comprises: grinding a phosphate mineral ore to provide a ground phosphate ore. In some such embodiments, the method further comprises combining the ground phosphate ore with at least a portion of the medium to form a medium-ore slurry. In some such embodiments, the method further comprises adjusting the particle size distribution of particles of the phosphate ore in the medium-ore slurry by passing the medium-ore slurry through a mesh screen, hydrocycloning the medium-ore slurry, desliming the medium ore slurry, or any combination thereof. In some such embodiments, the method further comprises combining the medium-ore slurry with the collector, beneficiating agent, and optionally a second portion of the medium to form the sparge composition.

There is provided herein a use of any of the sparge compositions disclosed herein to refine a phosphate ore. In some embodiments of the use, the phosphate ore is used to produce phosphoric acid.

DETAILED DESCRIPTION

Figure 1:
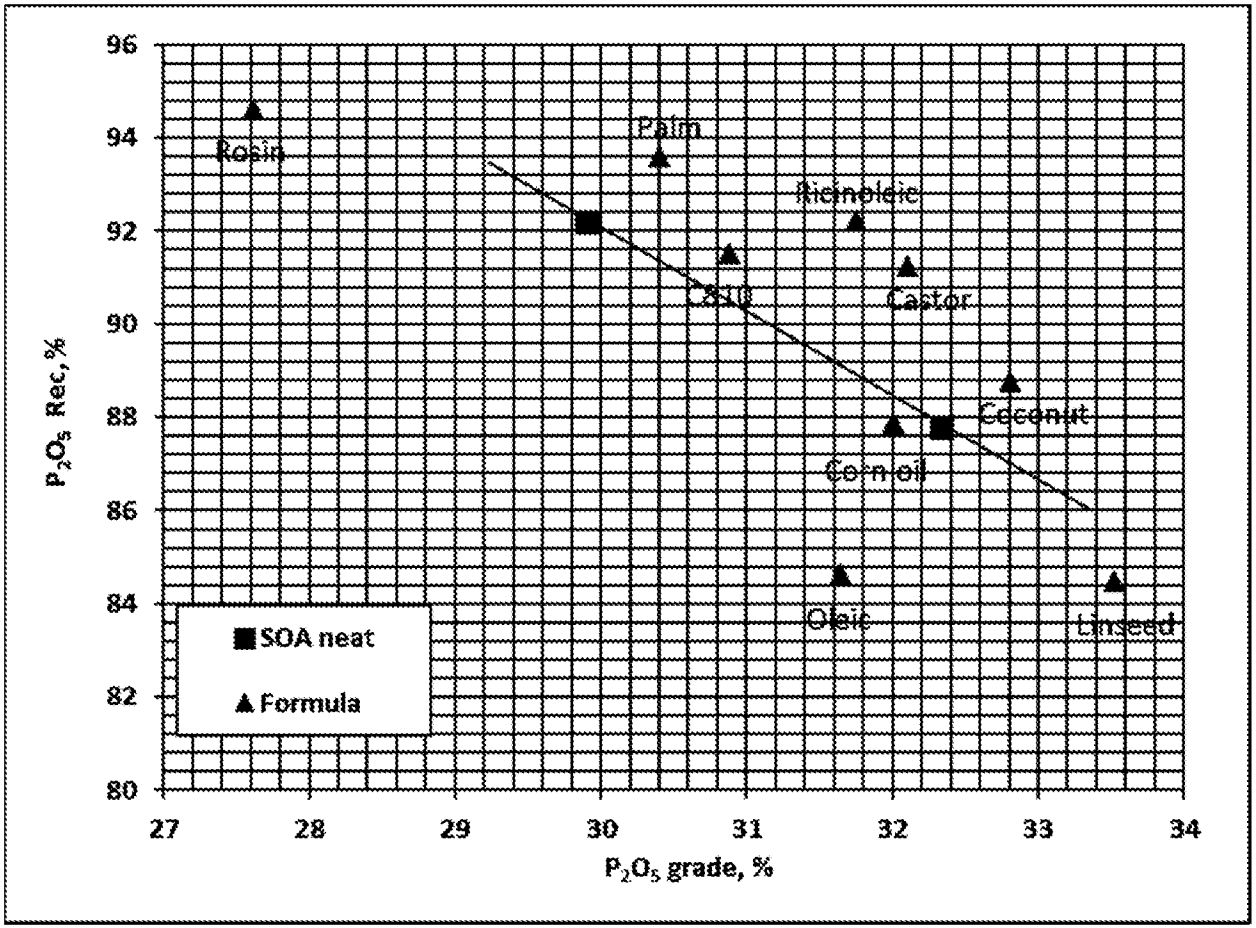
FIG. 1 shows a plot of phosphate recovery versus phosphate grade in the froth flotation of sparge compositions comprising various soaps and salts.

Although the present disclosure provides references to preferred embodiments, persons skilled in the art will recognize that changes may be made in form and detail without departing from the spirit and scope of the invention. Reference to various embodiments does not limit the scope of the claims attached hereto. Additionally, any examples set forth in this specification are not intended to be limiting and merely set forth some of the many possible embodiments for the appended claims.

Definitions

Unless otherwise defined, all technical and scientific terms used herein have the same meaning as commonly understood by one of ordinary skill in the art. In case of conflict, the present document, including definitions, will control.

As used herein, the terms "comprise(s)," "include(s)," "having," "has," "can," "contain(s)," and variants thereof are intended to be open-ended transitional phrases, terms, or words that do not preclude the possibility of additional acts or structures. The singular forms "a," "and" and "the" include plural references unless the context clearly dictates otherwise. The present disclosure also contemplates other embodiments "comprising," "consisting of" and "consisting essentially of," the embodiments or elements presented herein, whether explicitly set forth or not.

As used herein, the term "optional" or "optionally" means that the subsequently described event or circumstance may but need not occur, and that the description includes instances where the event or circumstance occurs and instances in which it does not.

As used herein, the term "about" modifying, for example, the quantity of an ingredient in a composition, concentration, volume, process temperature, process time, yield, flow rate, pressure, and like values, and ranges thereof, employed in describing the embodiments of the disclosure, refers to variation in the numerical quantity that can occur, for example, through typical measuring and handling procedures used for making compounds, compositions, concentrates or use formulations; through inadvertent error in these procedures; through differences in the manufacture, source, or purity of starting materials or ingredients used to carry out the methods, and like proximate considerations. The term "about" also encompasses amounts that differ due to aging of a formulation with a particular initial concentration or mixture, and amounts that differ due to mixing or processing a formulation with a particular initial concentration or mixture. Where modified by the term "about" the claims appended hereto include equivalents to these quantities. Further, where "about" is employed to describe a range of values, for example "about 1 to 5" or "about 1 to about 5", the recitation means "1 to 5" and "about 1 to about 5" and "1 to about 5" and "about 1 to 5" unless specifically limited by context.

As used herein, "ore" means any solid material of economic value that is obtained from a subterranean source by excavation, and also the refined or processed products of such solids. Excavation includes but is not limited to quarrying, open-cast mining, or pit mining. Ores include but are not limited to rocks, minerals, mineral aggregates, metal compounds including both elemental forms of metal and compounds including metal atoms, and any rank of coal (peat, lignite, sub-bituminous, bituminous, or anthracite). The ore includes a beneficiary.

As used herein, "phosphate ore" means an ore that comprises a phosphate group and/or phosphate moiety. In embodiments, the phosphate ore comprises, consists of, or consists essentially of $Ca^{2+}$, $PO_4^{3-}$, $F^-$, $OH^-$, $CO_3^{2-}$, silica and/or silicate, or any combination thereof. In embodiments, the phosphate ore comprises a phosphate beneficiary and a gangue comprising a carbonate, a silicate or a combination thereof.

As used herein, "phosphate beneficiary" means a beneficiary comprising a phosphate group and/or phosphate moiety. In embodiments, the phosphate beneficiary comprises, consists of, or consists essentially of $Ca^{2+}$ and $PO_4^{3-}$.

As used herein, "comminute" means to mechanically reduce the size of a solid mass. Non-limiting examples of comminuting include pulverizing and grinding.

As used herein, "fatty acid" is a carboxylic acid having an aliphatic chain of at least six carbon atoms.

As used herein, "sparge composition" means a mixture of materials comprising a comminuted ore, a liquid medium, and a collector. In embodiments, the liquid medium comprises, consists essentially of, or consists of water. In embodiments, the sparge composition further includes a froth.

As used herein, "sparged slurry" means a sparge composition that has been sparged, wherein the sparged slurry comprises an underflow and a froth.

As used herein, "sparged composition" means a sparge composition that has been sparged, wherein the sparged composition comprises an underflow and a froth.

As used herein, "concentrate" means that portion of an ore material in a sparge composition in which a beneficiary has been concentrated by a froth flotation process. The concentrate has a higher concentration of the beneficiary (as a ratio by weight of beneficiary to beneficiary plus gangue) than does the ore in the sparge composition before sparging.

As used herein, "tailings" means that portion of an ore material in a sparge composition in which a gangue has been concentrated by a froth flotation process. The tailings have a higher concentration of the gangue (as a ratio by weight of gangue to beneficiary plus gangue) than the ore in the sparge composition before sparging.

As used herein, "underflow" means a sparged slurry that excludes or substantially excludes froth.

As used herein, "froth" means a plurality of bubbles present in a sparge composition during sparging, after sparging, or both during and after sparging. The bubbles are formed by sparging a sparge composition with a gas. In embodiments, the gas is air.

As used herein, a "collector" means a material or mixture of materials that increases adhesion or association of the targeted particles to bubbles of a gas.

As used herein, a "depressant" means a material or mixture of materials that reduces the adhesion or association of untargeted particles to bubbles of a gas.

As used herein, a "frother" or "frothing agent" means a material or mixture of materials that facilitates the formation of a froth and/or inhibits a reduction in the number of bubbles within a froth during sparging, after sparging, or both during and after sparging.

As used herein, "dispersant" means a material or mixture of materials that increases the dispersion of particles in a liquid medium, stabilizes a dispersion of particles of an ore in a liquid medium, or both.

As used herein, the term "salt" means the conjugate base of a carboxylic acid and/or sulfonic acid moiety. The term "salt" refers not only to full salts but also to half-salts and the like, further as specified or determined by context herein. In embodiments, the salts comprise cations selected from $Na^+$, $K^+$, $NH_4^+$, and any combination thereof.

As used herein, "beneficiating agent" means a material or mixture of materials that improves the yield of a beneficiary at a given grade of concentrate in the reverse froth flotation of a sparge composition comprising a collector and the beneficiary, and optionally improves froth characteristics when compared with an otherwise identical sparge composition absent the beneficiating agent.

As used herein, "flotation" or "froth flotation" means a process in which a sparge composition is sparged to form a froth layer and an underflow.

As used herein, "hydroxy fatty acid composition" means a composition that comprises one or more hydroxy fatty acids, one or more hydroxy fatty acid salts, or any combination thereof.

As used herein, "hydroxy fatty acid" means a fatty acid having at least one hydroxyl group.

As used herein, "sulfonated fatty acid composition" means a composition consisting of, or consisting essentially of a compound or mixture of compounds that is a product of a sulfonating one or more fatty acids and/or salts thereof; or a compound or mixture of compounds that is a product of neutralizing or partially neutralizing with a base a compound or mixture of compounds that is a product of a sulfonating one or more fatty acids; further wherein each compound present in the sulfonated fatty acid composition comprises at least one —COOH group or salt thereof, and at least one —$SO_3H$ group or salt thereof.

As used herein, "sulfonated fatty acid" means a composition consisting of, or consisting essentially of a compound or mixture of compounds that is a product of the sulfonation of a fatty acid, further wherein the compound or each compound in the mixture of compounds comprises at least one —COOH group and at least one —$SO_3H$ group.

As used herein, "fatty acid monosulfonate" means a compound that is a product of a sulfonation of a fatty acid and/or a salt thereof, the compound comprising one —$SO_3H$ moiety or a salt thereof.

As used herein, "fatty acid disulfonate" means a compound that is a product of a sulfonation of a fatty acid and/or a salt thereof, the compound comprising two —$SO_3H$ moieties or a salt thereof.

As used herein, "phosphate" means a material comprising a phosphoric acid moiety or a salt thereof. As used herein, "phosphate anion" refers to $PO_4^{3-}$, $HPO_4^{2-}$, $H_2PO_4^-$, or any combination thereof as specified or determined by context herein.

As used herein, the term "soap of rosin", "rosin soap", and the like means a material or mixture of materials derived from saponification of rosin. In embodiments, the rosin is derived from plants such as pines and other conifers. The rosin comprises abietic acid. For example "sodium soap of rosin" refers to a material derived from saponification of rosin with a sodium base such as sodium hydroxide and comprising sodium abietate.

Herein, "refining" and the like refers to processing to remove gangue and/or unwanted constituents from a material such as an ore.

As used herein, "% grade" or "grade" means the percentage of the concentrate that is beneficiary by weight. Grade is thus a measure of how pure the concentrate is with respect to the beneficiary.

As used herein, "% recovery", "recovery", "recovery %" and the like refers to the weight of the beneficiary recovered from the concentrate as a percentage of the total beneficiary that is recovered from the concentrate and the tailings. Recovery is thus a measure of how much beneficiary is recovered in the concentrate rather than the tailings.

As used herein, "Kg/t" means kilograms per metric ton.

Discussion

Preferred methods and materials are described below, although methods and materials similar or equivalent to those described herein can be used in practice or testing of the present invention. All publications, patent applications, patents and other references mentioned herein are incorporated by reference in their entirety. The materials, methods, and examples disclosed herein are illustrative only and not intended to be limiting.

We have found that inclusion of a beneficiation agent comprising at least one hydroxy fatty acid and/or a salt thereof in a sparge composition comprising a comminuted phosphate ore and a sulfonated fatty acid composition unpredictably improves the purity and/or yield of phosphate beneficiary in reverse froth flotation of the sparge composition.

Sparge Compositions

Therefore, in embodiments, there is provided a sparge composition for reverse froth flotation, the sparge composition comprising, consisting of, or consisting essentially of: a liquid medium; a phosphate ore, the phosphate ore comprising, consisting of, or consisting essentially of a phosphate beneficiary and a gangue; a collector comprising, consisting of, or consisting essentially of a sulfonated fatty acid composition; and a beneficiating agent comprising, consisting of, or consisting essentially of a hydroxy fatty acid composition. In embodiments, the phosphate ore comprises, consists of, or consists of a comminuted phosphate ore.

In embodiments, the comminuted ore has a particle size as measured by ASTM C136 of 90% less than 4000 microns (#4 US standard mesh), in embodiments about 90% less than 1500 microns, in embodiments 90% less than 1000 microns, in embodiments 90% less than 500 microns, or in embodiments 90% less than 250 microns as measured by ASTM C136.

In embodiments, 1% to 99% by weight of the comminuted ore has a particle size as measured by ASTM C136 from about 38 microns to about 250 microns, in embodiments 50% to 80% by weight of the comminuted ore has a particle size from about 38 microns to about 250 microns, in embodiments 60% to about 70% has a particle size from about 38 microns to about 250 microns, in embodiments 65% to 70% has a particle size from about 38 microns to about 250 microns, or in embodiments about 68% has a particle size from about 38 microns to about 250 microns as measured by ASTM C136.

In embodiments, the liquid medium comprises, consists of, or consists essentially of water.

The phosphate ore comprises, consists of, or consists essentially of a phosphate beneficiary and a gangue. In embodiments, the gangue comprises carbonate anions, silicate anions, silica, or any combination thereof. In embodiments, the gangue comprises carbonate anions. In embodiments, the gangue comprises calcite, dolomite, a silicate, silica, or any combination thereof.

In embodiments, the phosphate ore comprises, consists of, or consists essentially of an apatite, a phosphorite, or a combination thereof. In embodiments the apatite comprises, consists of, or consists essentially of a hydroxylapatite, a fluorapatite, a chlorapatite, or any combination thereof.

In embodiments, the sparge composition further comprises a pH adjustment agent. In embodiments, the pH adjustment agent comprises, consists of, or consists essentially of an acid. In embodiments, the pH adjustment agent comprises, consists of, or consists essentially of a base. In embodiments, the pH adjustment agent comprises, consists of, or consists essentially of a buffer. In embodiments, the acid is selected from hydrochloric acid, sulfuric acid, p-toluene sulfonic acid, or any combination thereof. In embodiments, the pH adjustment agent comprises, consists of, or consists essentially of sulfuric acid.

In embodiments, the sparge composition has a pH of about 1 to about 3, in embodiments about 3 to about 6, in embodiments about 3 to about 7, in embodiments about 3 to about 8, in embodiments about 6 to about 10, in embodiments about 11 to about 14, in embodiments about 4 to about 7, in embodiments about 4 to about 5, in embodiments about 6 to about 7, in embodiments about 4.0 to about 5.5, or in embodiments about 5.0 to about 5.2.

In embodiments, the pH of the sparge composition is 4.3 to 6.8.

In embodiments, the beneficiating agent comprises, consists of, or consists essentially of a hydroxy fatty acid composition; and the collector comprises, consists of, or consists essentially of a sulfonated fatty acid composition, wherein the weight of the sulfonated fatty acid composition divided by the weight of the hydroxy fatty acid composition is about 0.01 to about 99, or in embodiments about 0.05 to about 1.2, or in embodiments about 0.05 to about 1.1, or in embodiments about 0.1 to about 1.1, or in embodiments about 0.1 to about 1, or in embodiments about 0.20 to about 1.0, or in embodiments about 0.30 to about 1.0, in embodiments about 0.40 to about 1.0, or in embodiments about 0.66.

In some such embodiments, the sum of the weight of the sulfonated fatty acid composition plus the weight of the hydroxy fatty acid composition is about 0.001% to about 5% of the weight of the phosphate ore, or in embodiments about 0.001% to about 1%, or in embodiments about 0.01% to about 1%, or in embodiments about 0.05% to about 0.7%, or in embodiments about 0.1% to about 0.3% of the weight of the phosphate ore.

In some such embodiments, the hydroxy fatty acid composition comprises, consists of, or consists essentially of a ricinoleic acid salt, and the sulfonated fatty acid composition comprises, consists of, or consists essentially of a sulfonated oleic acid salt. In some such embodiments, the ricinoleic acid salt comprises, consists of, or consists essentially of sodium ricinoleate, potassium ricinoleate, or a combination thereof; and the sulfonated oleic acid salt comprises, consists of, or consists essentially of sulfonated oleic acid potassium salt, a sulfonated oleic acid sodium salt, or a combination thereof. In embodiments, the sulfonated fatty acid composition consists of or consists essentially of sulfonated oleic acid potassium salt, sulfonated oleic acid sodium salt, or a combination thereof; and the hydroxy fatty acid composition consists of or consists essentially of sodium ricinoleate, potassium ricinoleate, or a combination thereof.

In embodiments, the concentration by weight of the hydroxy fatty acid composition in the sparge composition is about 0.001% to about 5%, in embodiments about 0.01% to about 0.5%, in embodiments about 0.02% to about 0.15%, or in embodiments about 0.03% to about 0.12%.

In embodiments, the concentration of the sulfonated fatty acid composition in the sparge composition by weight is about 0.001% to about 5%, or in embodiments about 0.01% to about 0.5%, or in embodiments about 0.01% to about 0.15%.

In embodiments, the amount of the phosphate ore in the sparge composition is about 1% to about 80%, in embodiments about 10% to about 40%, or in embodiments about 20% to about 30% by weight of the sparge composition.

Beneficiating Agents of the Sparge Composition

The sparge compositions comprise one or more beneficiating agents. The beneficiating agent comprises, consists of, or consists essentially of a hydroxy fatty acid composition. The hydroxy fatty acid composition consists essentially of one or more hydroxy fatty acids, one or more hydroxy fatty acid salts, or a combination thereof. In some embodiments, the hydroxy fatty acid composition comprises, consists of, or consists essentially of two or more hydroxy fatty acids and/or salts thereof. In other embodiments, the hydroxy fatty acid composition comprises, consists of, or consists essentially of one hydroxy fatty acid, a salt of a hydroxy fatty acid, or a combination thereof.

In embodiments, a salt of an hydroxy fatty acid comprises, consists of, or consists essentially of a sodium salt of the hydroxy fatty acid, a potassium salt of the hydroxy fatty acid, or an ammonium salt of the hydroxy fatty acid. In embodiments, the ammonium salt of the hydroxy fatty acid consists of or consists essentially of an inorganic-ammonium ($NH_4^+$) salt, a primary organic ammonium salt, a secondary organic ammonium salt, a tertiary organic ammonium salt, or a quaternary organic ammonium salt.

In embodiments, the hydroxy fatty acid is any fatty acid with at least one hydroxyl group.

In embodiments, the hydroxy fatty acid comprises a hydrocarbon chain with at least one hydroxyl group and at least one carboxyl group attached thereto. In embodiments, the hydrocarbon chain has one, two, or three hydroxyl groups attached thereto. In embodiments, the hydrocarbon chain is aliphatic. In embodiments the hydrocarbon chain is branched or straight-chain. In some embodiments the hydrocarbon chain includes at least one —C═C— double bond, in other embodiments the hydrocarbon chain is saturated. In embodiments, the hydrocarbon chain includes one —C═C— double bond or two —C═C— double bonds. In embodiments, the hydrocarbon chain comprises 5 to 50 carbon atoms, in embodiments 10 to 30 carbon atoms, in embodiments 15 to 25 carbon atoms, in embodiments 15 to 21 carbon atoms, or in embodiments 16 to 20 carbon atoms. In embodiments, the hydroxy fatty acid composition comprises two or more hydroxy fatty acids differing from each other with respect to number of carbon atoms in the hydrocarbon chain.

In embodiments, the hydroxy fatty acid composition comprises, consists of, or consists essentially of a hydroxy fatty acid having the structural formula $$C_aH_{2a+1}(CHOH)_b(CH_2)(CH{=}CH)_c(CH_2)_dCOOH$$

and/or a salt thereof, wherein a is an integer from 1 to 10; b is an integer from 1 to 5; c is 0 or 1; and d is an integer from 5 to 10. In some embodiments where c=1, the CH═CH is cis, in other such embodiments the CH═CH is trans. In some embodiments, the $C_aH_{2a+1}$ group is a linear n-alkyl group. In other embodiments, the $C_aH_{2a+1}$ group is a branched alkyl group.

In embodiments, the hydroxy fatty acid composition comprises, consists of, or consists essentially of a fatty acid having the structural formula $$CR_1R_2OH(CH_2)_e(CHOH)_f(CH_2)_gCOOH$$

and/or a salt thereof, wherein $R_1$ and $R_2$ are independently selected from C1-C5 alkyl and hydrogen; e is an integer from 1 to 10; f is 0 or an integer from 1 to 5; and g is an integer from 1 to 20. In some such embodiments, $R_1$ and $R_2$ are both hydrogen.

In embodiments, the hydroxy fatty acid composition comprises, consists of, or consists essentially of a hydroxy fatty acid having the structural formula $$C_aH_{2a+1}(CH{=}CH)(CH_2)_h(CHOH)(CH_2)_i(CH{=}CH)_k(CH_2)_mCOOH$$

and/or a salt thereof, wherein a is an integer from 1 to 10; h is an integer from 1 to 10; i is 0 or an integer from 1 to 10; k is 0 or 1, with the proviso that if i=0 then k=0; and m is 0 or an integer from 1 to 10. In some such embodiments, every CH═CH is cis, in some other such embodiments every CH═CH is trans, in still other such embodiments, the hydroxy fatty acid has one cis CH═CH and one trans (CH═CH). In some embodiments, $C_aH_{2a+1}$ is a linear n-alkyl group.

In embodiments, the hydroxy fatty acid composition comprises a fatty acid having the structural formula $$C_aH_{2a+1}(CHOH)_j(CH_2)_q(CH{=}CH)(CH_2)_h(CH{=}CH)(CH_2)_i(CHOH)_pCOOH$$

and/or a salt thereof, wherein a is an integer from 1 to 10; j is 0 or an integer from 1 to 5; q is 0 or an integer from 1 to 10, with the proviso that if j>0 then q is at least 1; h is an integer from 1 to 10; p is 0 or 1, with the proviso that j+p>0; and i is 0 or an integer from 1 to 7, with the proviso that if i is 0 then p is also 0. In some such embodiments, both CH═CH are cis, in other such embodiments both CH═CH are trans, in still other such embodiments, one CH═CH group is cis and the other CH═CH group is trans.

In embodiments, the hydroxy fatty acid composition comprises, consists of, or consists essentially of a hydroxy fatty acid having the empirical formula $$C_nH_{(2n+1-x)}(OH)_x(CR_3{=}CR_4)_yCO_2H$$

and/or a salt thereof, wherein n is an integer from 5 to 25, x is an integer from 1 to 5, y is 0 or an integer from 1 to 3, and $R_3$ and $R_4$ are independently selected from alkyl or hydrogen. In this context, the empirical formula $C_nH_{(2n+1-x)})(OH)_x(CH{=}CH)_yCO_2H$ means that a molecule of the hydroxy fatty acid comprises one —COOH group, from 1 to 5 —OH groups, and at least one alkyl and/or alkylene group; but the empirical formula does not indicate the arrangement of these groups in the molecule. For example, the $C_nH(_{2n+1-x})(OH)_x$ can be split up by one or more intervening CH═CH double bonds into two or more alkylene groups or two or more alkylene groups and an alkyl group. Furthermore, the $C_nH(_{2n+1-x})(OH)_x$ can have any arrangement with respect to (OH) groups. In embodiments, $CR_3{=}CR_4$ is cis.

In embodiments, the hydroxy fatty acid composition comprises, consists of, or consists essentially of ricinoleic acid, a salt of ricinoleic acid, 12-hydroxystearic acid, a salt of 12-hydroxystearic acid, 9,10-dihydroxyoctadecanoic acid, a salt of 9,10-dihydroxyoctadecanoic acid, 9,10,18-trihydroxyoctadecanoic acid (phloionolic acid), a salt of phloionolic acid, lesquerolic acid (n-$C_6H_{13}(CHOH)CH_2(CH{=}CH)(CH_2)_9COOH$), a salt of lesquerolic acid, 15-hydroxyhexadecanoic acid, a salt of 15-hydroxyhexadecanoic acid, isoricinoleic acid (cis n-$C_5H_{11}(CH{=}CH)(CH_2)_2(CHOH)(CH_2)_7COOH$), a salt of isoricinoleic acid, densipolic acid (cis, cis n-$C_2H_5(CH{=}CH)(CH_2)_2(CHOH)CH_2(CH{=}CH)(CH_2)_7COOH$), a salt of densipolic acid, 14-hydroxy-eicosa-cis-11-cis-17-dienoic acid (auricolic acid, n-$C_2H_5(CH{=}CH)(CH_2)_2(CHOH)CH_2(CH{=}CH)(CH_2)_9COOH$)), a salt of auricolic acid, 2-hydroxyoleic acid, a salt of 2-hydroxyoleic acid, 2-hydroxylinoleic acid, a salt of 2-hydroxylinoleic acid, 18-hydroxystearic acid, a salt of 18-hydroxystearic acid, 15-hydroxylinoleic acid, a salt of 15-hydroxylinoleic acid, or any combination thereof.

In embodiments, the hydroxy fatty acid composition comprises, consists of, or consists essentially of a sodium ricinoleate, potassium ricinoleate, sodium 12-hydroxystearate, potassium 12-hydroxystearate, sodium 9,10-dihydroxyoctadecanoate, potassium 9,10-dihydroxyoctadecanoate, sodium phloionolate, potassium phloionolate acid, sodium lesquerolate, potassium lesquerolate, sodium 15-hydroxyhexadecanoate, potassium 15-hydroxyhexadecanoate, sodium isoricinoleate, potassium isoricinoleate, sodium densipolate, potassium densipolate, sodium auricolate, potassium auricolate, sodium 2-hydroxyoleate, potassium 2-hydroxyoleate, sodium 2-hydroxylinoleate, potassium 2-hydroxylinoleate, sodium 18-hydroxystearate, potassium 18-hydroxystearate, sodium 15-hydroxylinoleate, potassium 15-hydroxylinoleate, or any combination thereof.

In embodiments, the beneficiating agent comprises, consists of, or consists essentially of a salt of ricinoleic acid. In embodiments, the salt of the ricinoleic acid is the product of the hydrolysis of castor oil. In embodiments, the hydrolysis of the castor oil is a saponification of the castor oil with an alkali. In embodiments, the alkali is selected from aqueous sodium hydroxide, aqueous potassium hydroxide, or an aqueous ammonium hydroxide. In embodiments, the ammonium of the aqueous ammonium hydroxide is selected from inorganic ammonium, primary organic ammonium, secondary organic ammonium, tertiary organic ammonium, quaternary organic ammonium, or any combination thereof. In embodiments, the salt of the ricinoleic acid comprises, consists of, or consists essentially of sodium ricinoleate or potassium ricinoleate. In some such embodiments, the sodium ricinoleate or potassium ricinoleate is the product of the saponification of castor oil with aqueous sodium hydroxide or aqueous potassium hydroxide respectively.

In embodiments, the salt of the hydroxy fatty acid is selected from an ammonium salt, a sodium salt, or a potassium salt of the hydroxy fatty acid. In embodiments, the ammonium is inorganic ammonium ($NH_4^+$), primary organic ammonium, secondary organic ammonium, tertiary organic ammonium, or quaternary organic ammonium.

In embodiments, the hydroxy fatty acid, the salt of the hydroxy fatty acid, or the combination thereof is a product of hydrolysis of a natural oil. In embodiments, the natural oil is castor oil. In embodiments, the hydrolysis is a saponification with an alkali. In embodiments, the alkali comprises, consists of, or consists essentially of aqueous sodium hydroxide, aqueous potassium hydroxide, an aqueous ammonium hydroxide, or any combination thereof.

In embodiments, the hydroxy fatty acid, the salt of the hydroxy fatty acid, or the combination thereof is a product of hydrolysis of a triglyceride that is the ester of at least one hydroxy fatty acid. In embodiments, the hydrolysis is a saponification with an alkali. In embodiments, the alkali comprises, consists of, or consists essentially of aqueous sodium hydroxide, aqueous potassium hydroxide, an aqueous ammonium hydroxide, or any combination thereof.

In embodiments, the hydroxy fatty acid composition of the sparge composition comprises more than one type of hydroxy fatty acid, more than one type of salt of a hydroxy fatty acid, more than one salt of one or more hydroxy fatty acids, or any combination thereof.

Collectors of the Sparge Composition

In embodiments, the collector comprises, consists of, or consists essentially of a sulfonated fatty acid composition. In embodiments, the sulfonated fatty acid composition comprises, consists of, or consists essentially of one or more sulfonated fatty acids, one or more sulfonated fatty acid salts, or any combination thereof. In some embodiments, the one or more sulfonated fatty acids, one or more sulfonated fatty acid salts, or the combination thereof comprises, consists of, or consists essentially of a sulfonated fatty acid, a sulfonated fatty acid salt, or a combination thereof.

In embodiments, the sulfonated fatty acid composition comprises, consists of, or consists essentially of a compound or mixture of compounds that is a product of a sulfonation of one or more fatty acids and/or salts thereof, or is the product of neutralizing or partially neutralizing with a base the compound or mixture of compounds that is a product of a sulfonation of the one or more fatty acids; further wherein each compound present in the sulfonated fatty acid composition comprises at least one —COOH group or salt thereof, and at least one —$SO_3H$ group or salt thereof. The compound or each compound in the mixture of compounds has a —COOH group or a —$CO_2^-$ group, and at least one —$SO_3H$ group or $SO_3^-$ group. Therefore, the sulfonated fatty acid composition comprises one or more fatty acids having sulfonic acid groups and/or salts thereof.

In embodiments, the sulfonated fatty acid composition comprises, consists of, or consists essentially of sulfonated oleic acid, a sulfonated oleic acid salt, sulfonated linoleic acid, a sulfonated linoleic acid salt, sulfonated linolenic acid, a sulfonated linolenic acid salt, sulfonated ricinoleic acid, a sulfonated ricinoleic acid salt, sulfonated palmitoleic acid, a sulfonated palmitic acid salt, sulfonated 11-eicosenoic acid, a sulfonated 11-eicosenoic acid salt, sulfonated erucic acid, a sulfonated erucic acid salt, sulfonated nervonic acid, a sulfonated nervonic acid salt, sulfonated abietic acid, a sulfonated abietic acid salt, or any combination thereof.

In embodiments, the sulfonated fatty acid composition comprises one or more sulfonated fatty acid sodium salts, one or more sulfonated fatty acid potassium salts, one or more sulfonated fatty acid ammonium salts, or any combination thereof. In embodiments, the ammonium is selected from inorganic ammonium ($NH_4^+$), primary organic ammonium, secondary organic ammonium, tertiary organic ammonium, quaternary organic ammonium, or any combination thereof. In embodiments, the sulfonated fatty acid composition is a neutralized or partly neutralized product of a sulfonation of a saturated fatty acid with a sulfonating agent. In this context, neutralized or partially neutralized means reacted with a base. In embodiments, the sulfonating agent is selected from sulfur trioxide, oleum, chlorosulfonic acid, and sulfuric acid.

In embodiments, the sulfonated fatty acid composition comprises, consists of, or consists essentially of a sulfonated oleic acid potassium salt.

In embodiments, the sulfonated fatty acid is a product of a sulfonation of a fatty acid derived from a hydrolysis of a triglyceride.

In embodiments, the sulfonated fatty acid composition is a product or neutralized product of a sulfonation of a fatty acid or mixture of fatty acids derived from a hydrolysis of an oil selected from the group consisting of linseed oil, cottonseed oil, soy-bean oil, canola oil, castor oil, coconut oil, palm oil, jojoba oil, olive oil, peanut oil, sunflower oil, animal fat, tall oil, and any combination thereof. In embodiments, the tall oil is a byproduct of paper-making.

In embodiments, the sulfonated fatty acid composition comprises, consists of, or consists essentially of a fatty acid monosulfonate, a fatty acid disulfonate, one or more fatty acid sulfonate dimers, one or more fatty acid sulfonate trimers, or any combination thereof. In some such embodiments, the sulfonated fatty acid composition comprises a salt of the fatty acid monosulfonate, a salt of the fatty acid disulfonate, one or more salts of the one or more fatty acid sulfonate dimers, one or more salts of the fatty acid sulfonate trimers, or any combination thereof.

A fatty acid sulfonate is a compound that is a product of a sulfonation of a fatty acid, wherein the compound has at least one —$SO_3H$ group or a salt thereof. In embodiments, a sulfonated fatty acid composition comprises, consists of, or consists essentially of one or more fatty acid sulfonates. A fatty acid monosulfonate is a monosulfonated compound that is a product of a sulfonation of a fatty acid, the monosulfonated compound comprising one —$SO_3H$ or one —$SO_3^-$ group per molecule of the monosulfonated compound. A fatty acid disulfonate is a disulfonated compound that is a product of a sulfonation of a fatty acid, the disulfonated compound comprising two —$SO_3H$ groups, two —$SO_3^-$ groups, or one —$SO_3H$ and one —$SO_3^-$ group per molecule of the disulfonated compound. A fatty acid sulfonate dimer is a compound resulting from a chemical combination of a fatty acid sulfonate or its salt with a fatty acid, a fatty acid salt, a fatty acid sulfonate, or a salt of a fatty acid sulfonate.

A fatty acid sulfonate trimer is a compound resulting from a combination of two molecules of a fatty acid and/or its salt with one molecule of a fatty acid sulfonate or its salt; one molecule of a fatty acid or its salt and two molecules of a fatty acid and/or its salt; and/or three molecules of a fatty acid sulfonate and/or its salt.

In embodiments, during the sulfonation of fatty acids with a sulfonating agent, one or more fatty acid monosulfonates, fatty acid disulfonates, fatty acid sulfonate dimers, fatty acid sulfonate trimers, fatty acid oligomers, and/or any combination thereof are produced. In the way of illustration only, in one non-limiting example, the sulfonated fatty acid composition is derived from a sulfonation of oleic acid and comprises unsaturated oleic acid monosulfonate (I), a salt of unsaturated oleic acid monosulfonate (I), saturated hydroxy oleic acid monosulfonate (II), a salt of saturated hydroxy oleic acid monosulfonate (II), oleic acid 8,10-disulfonate (III), a salt of oleic acid 8,10-disulfonate (III), oleic acid 9,10-disulfonate (IV), a salt of oleic acid 9,10-disulfonate (IV), dimer (V), a salt of dimer (V), hydroxy sulfonated dimer (VI), a salt of hydroxy sulfonated dimer (VI), sulfonated dimer (VII), a salt of sulfonated dimer (VII), saturated dimer (VIII), a salt of saturated dimer (VIII), trimer (IX), a salt of trimer (IX), saturated trimer (X), a salt of saturated trimer (X), doubly unsaturated dimer (XI), a salt of doubly unsaturated dimer (XI), C14-C18 dimer (XII), a salt of C14-C18 dimer (XII), monounsaturated dimer (XIII), a salt of monounsaturated dimer (XIII), C18-C14 dimer (XIV), a salt of C18-C14 dimer (XIV), or any combination thereof. In such embodiments, the fatty acid salt composition comprises, consists of, or consists essentially of a salt or salts of any one or more of (I), (II), (III), (IV), (V), (VI), (VII), (VIII), (IX), (X), (XI), (XII), (XIII), and (XIV).

(I)

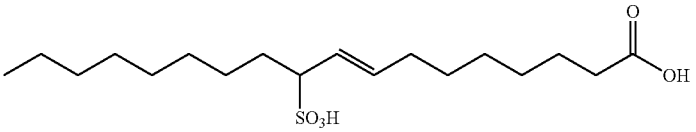

(II)

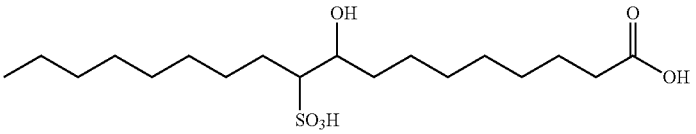

(III)

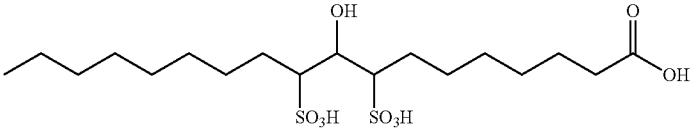

(IV)

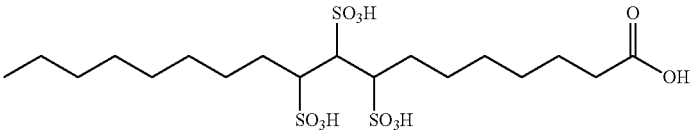

(V)

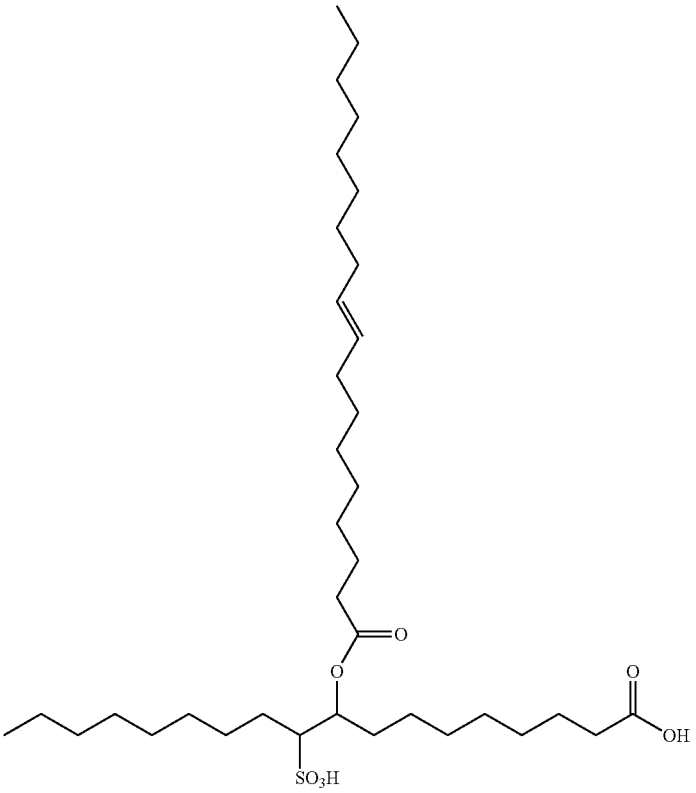

-continued
(VI)
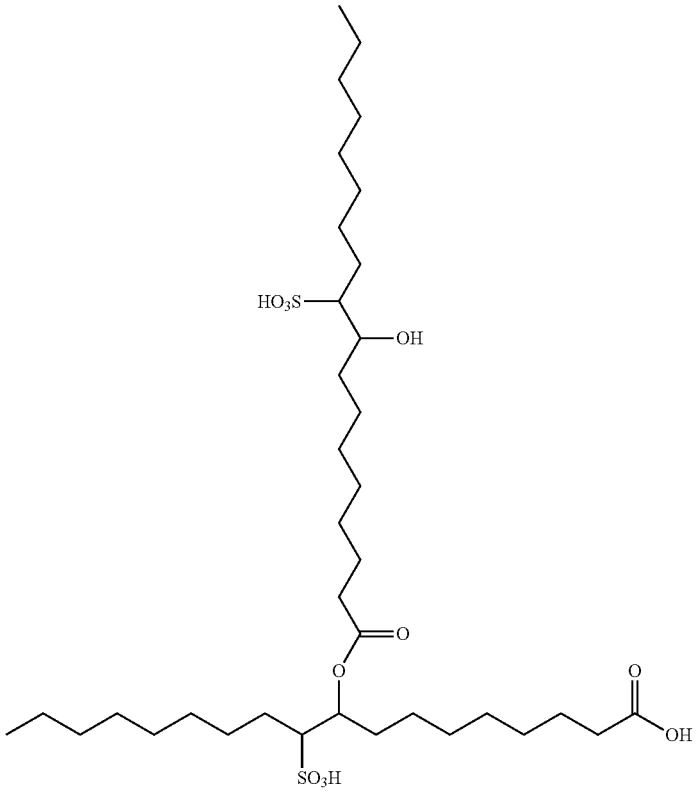
(VII)
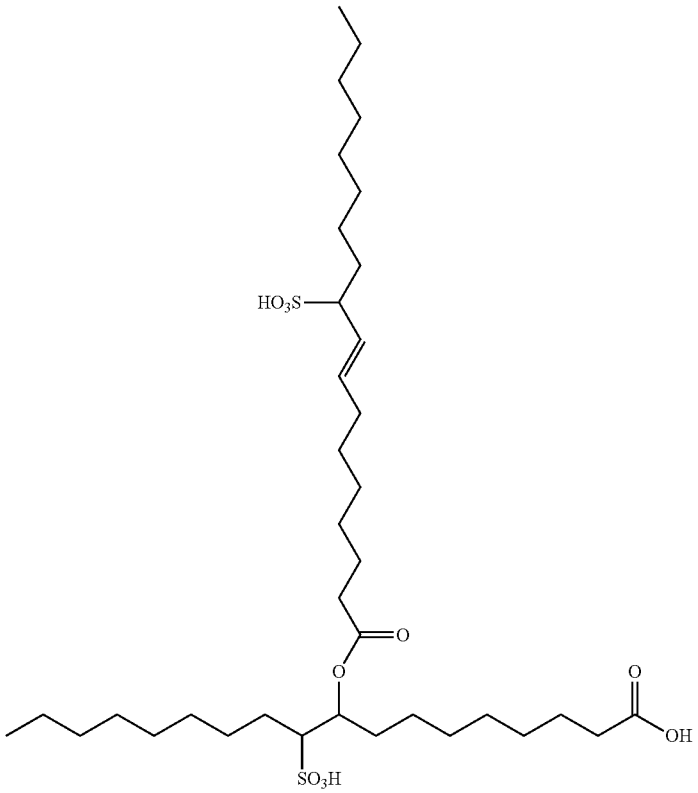

-continued
(VIII)
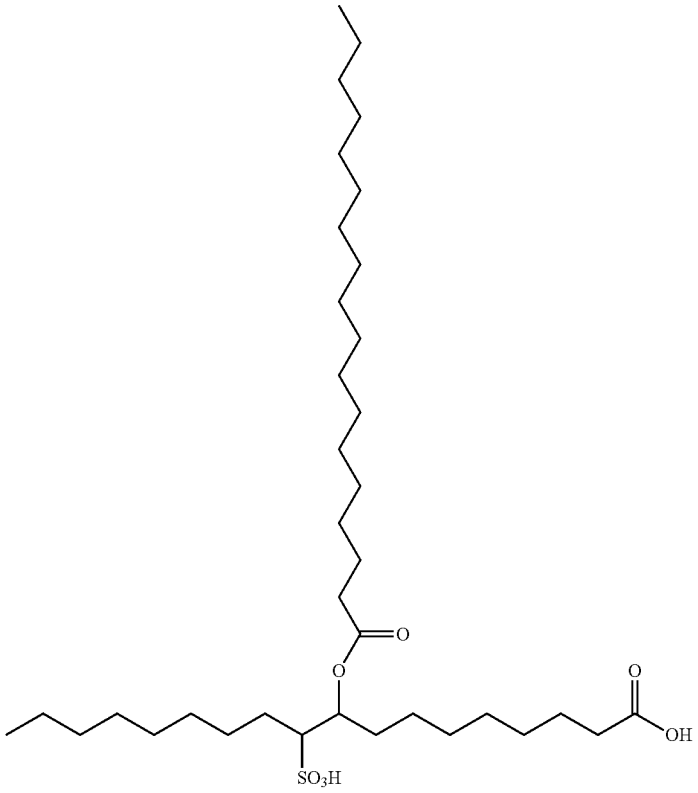
(IX)
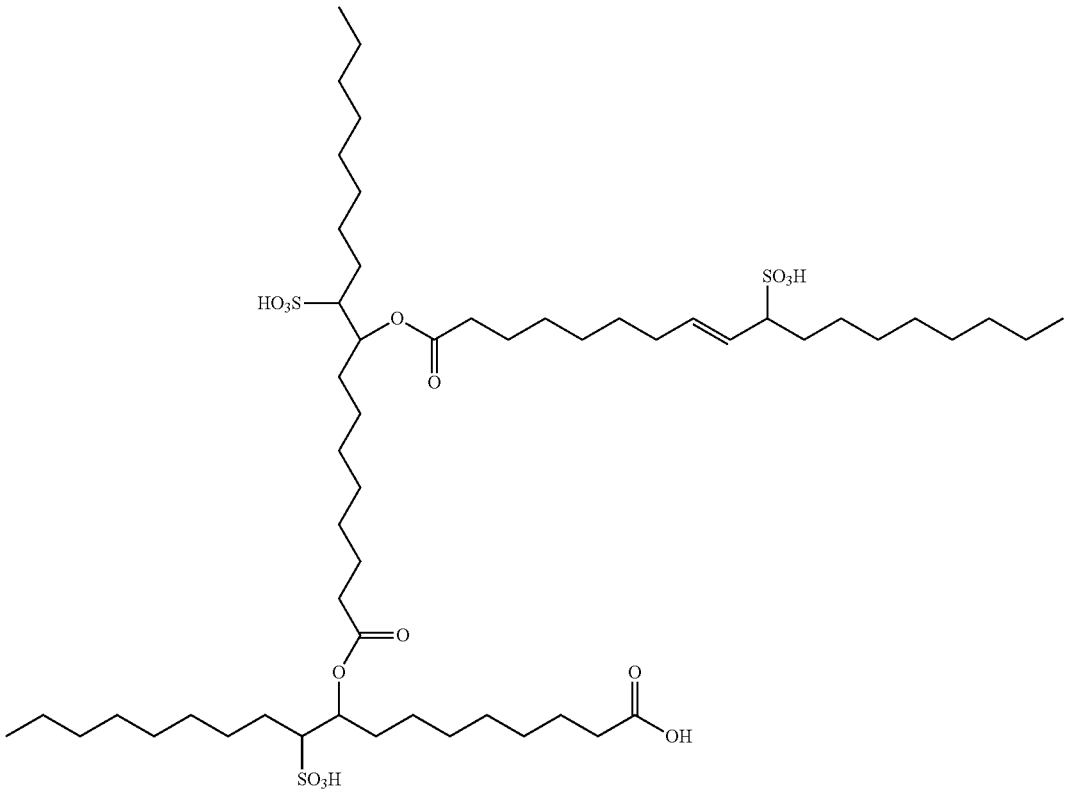

-continued
(X)
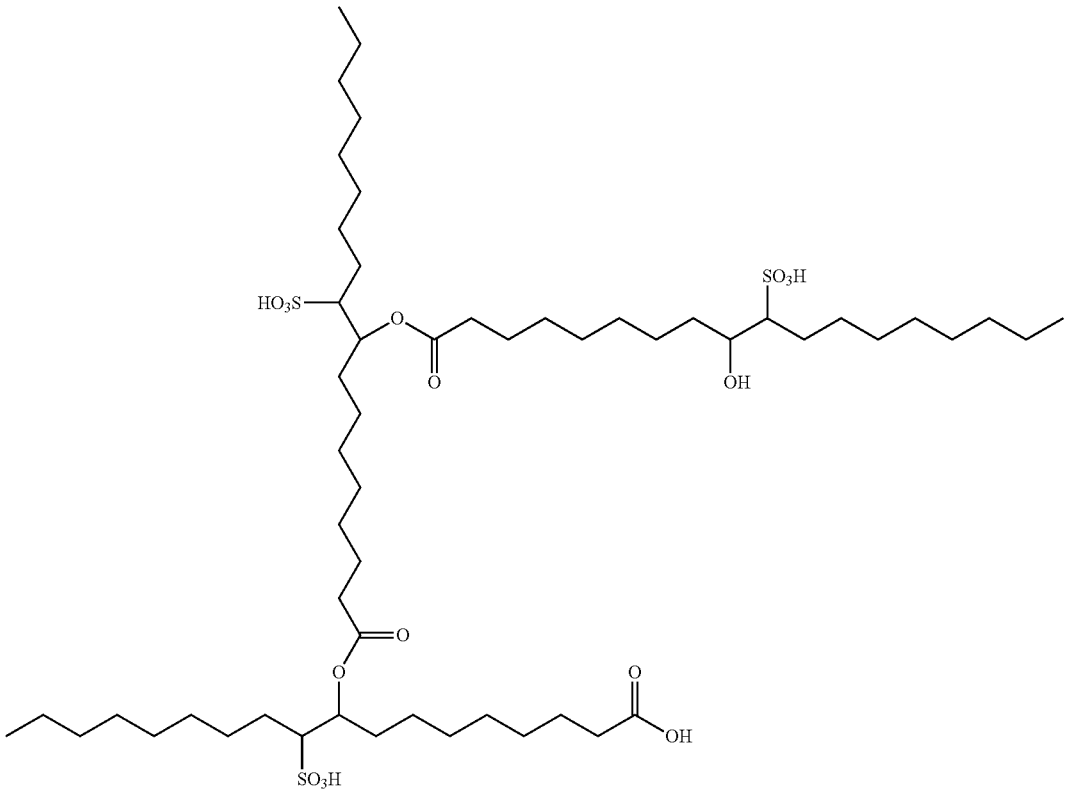
(XI)
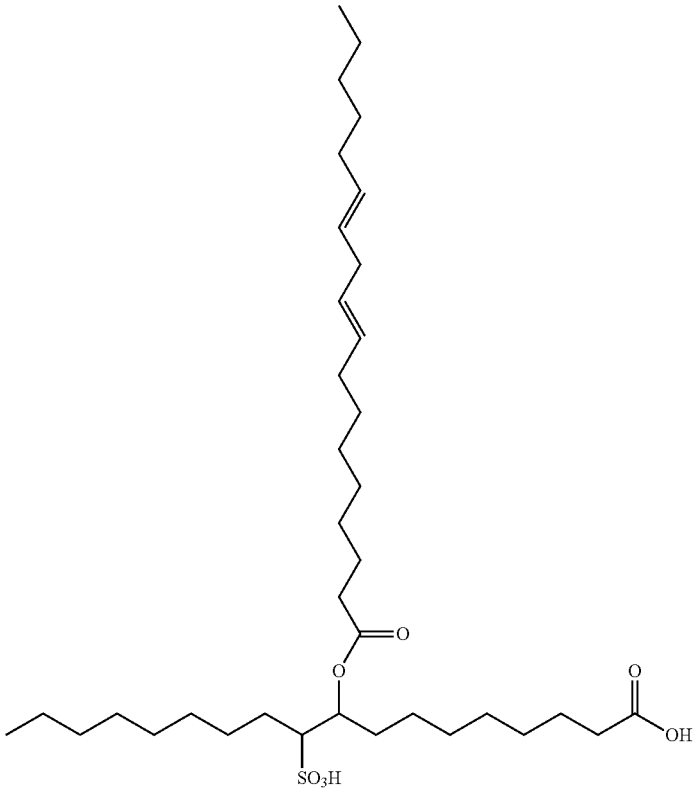

-continued
(XII)
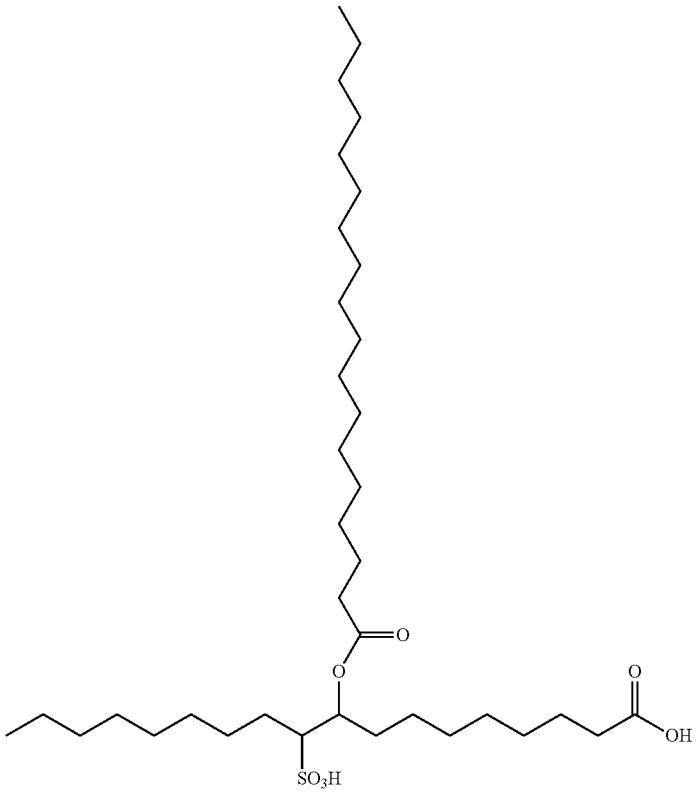
(XIII)
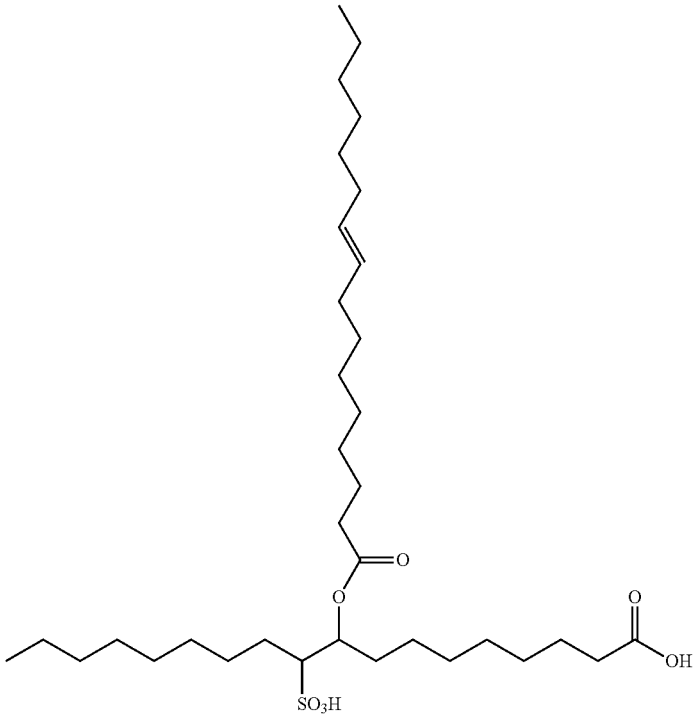

-continued (XIV)

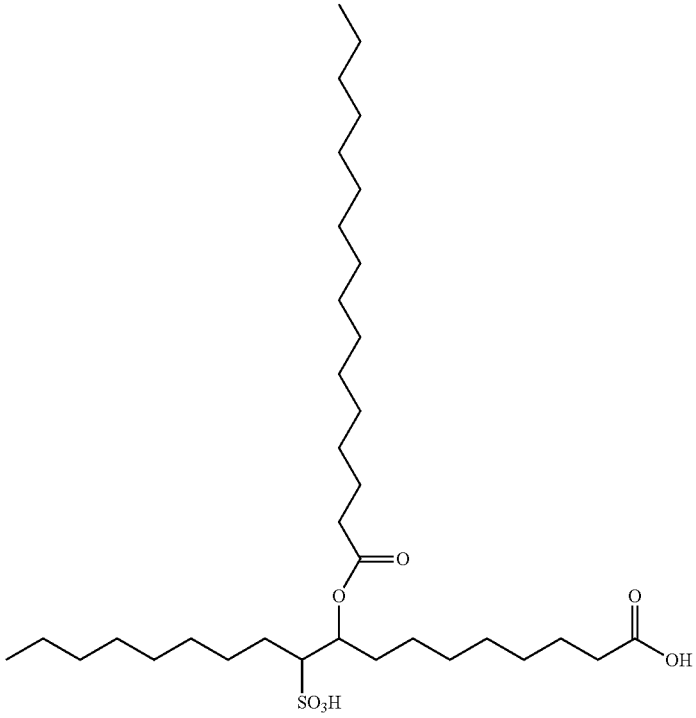

Sulfonation of other fatty acids other than oleic acid as exemplified above can also produce a mixture of compounds. The mixture of compounds in such embodiments depends on the fatty acid or mixture thereof that is sulfonated.

Sulfonated fatty acids such as sulfonated oleic acid can be neutralized or partially neutralized with bases such as aqueous sodium hydroxide, aqueous potassium hydroxide, or an aqueous ammonium hydroxide, as well as other bases such as sodium carbonate and sodium bicarbonate to produce a sulfonated fatty acid salt. In the salt, some or all of the sulfonic acid and carboxylic acid groups in the sulfonated fatty acid are converted to sulfonate and carboxylate groups respectively. Whether the collector and/or the sulfonated fatty acid composition comprises one or more fatty acid sulfonates or one or more sulfonated fatty acid salts can depend on the pH of the sparge composition.

Saturated fatty acids and unsaturated fatty acids can be sulfonated by means known in the art to produce sulfonated fatty acids and their salts useful as collectors in the sparge compositions of the invention. The sulfonation of both saturated and unsaturated fatty acids is described for example, in U.S. Pat. No. 1,926,442. In embodiments, the sulfonated fatty acid salt composition comprises, consists of, or consists essentially of one or more salts of a sulfonated saturated fatty acid, one or more salts of a sulfonated unsaturated fatty acid, salts of more than one sulfonated saturated fatty acid, salts of more than one unsaturated fatty acid, or any combination thereof.

Methods of Sparging

In embodiments, there is provided a method of sparging comprising: sparging any of the sparge compositions disclosed herein to yield a sparged slurry comprising a froth and an underflow, wherein the underflow comprises a concentrate and a first portion of the medium, and the froth comprises tailings and a second portion of the medium. The concentrate comprises, consists of, or consists essentially of the beneficiary. The tailings comprise, consist of, or consist essentially of the gangue. In embodiments, the beneficiary comprises, consists of, or consists essentially of a phosphate. In embodiments, the gangue comprises, consists of, or consists essentially of a carbonate, a silicate, silica, or any combination thereof.

In embodiments, the sparge composition of the method comprises, consists of, or consists essentially of water; ricinoleic acid, a salt of ricinoleic acid, or a combination thereof; a sulfonated oleic acid, a salt of sulfonated oleic acid, or a combination thereof; and phosphate ore comprising apatite, calcite, dolomite, and silicate; and sulfuric acid.

In embodiments, the method further comprises separating at least a portion of the concentrate from at least a portion of the tailings. In embodiments, the at least the portion of the concentrate is about 90% to 100% by weight of the concentrate in the underflow, in embodiments about 95% to 100%, in embodiments about 98% to 100%, in embodiments about 99% to 100%, or 100% by weight of the concentrate in the underflow. In embodiments the at least the portion of the tailings is about 90% to 100% by weight of the tailings in the froth, in embodiments about 95% to 100%, in embodiments about 98% to 100%, in embodiments about 99% to 100%, or 100% by weight of the tailings in the froth.

In embodiments, the separating the at least the portion of the concentrate from the at least the portion of the tailings comprises, consists of, or consists essentially of separating at least a portion of the froth from at least a portion of the underflow. In embodiments, the separating the at least the portion of the concentrate from the at least the portion of the tailings comprises, consists of, or consists essentially of separating at least a portion of the concentrate from at least a portion of the underflow.

In embodiments, the method of sparging comprises separating at least a portion of the froth from at least a portion of the underflow.

In embodiments, the method of sparging comprises separating at least a portion of the concentrate from at least a portion of the underflow.

Sparging the sparge composition yields a sparged slurry, the sparged slurry comprising, consisting of, or consisting essentially of a froth layer and an underflow. During and after sparging, bubbles of gas migrate through the sparged composition to the liquid-air interface and form a froth thereat.

The underflow comprises concentrate and the froth layer comprises tailings. In some such embodiments, the method comprises separating at least a portion of the froth layer from at least a portion of the underflow. Separating the at least the portion of the froth layer from the at least the portion of the underflow is accomplished by conventional methods known in the art. In embodiments, the separating comprises, consists of, or consists essentially of: tapping off at least a portion of the froth layer, skimming off at least a portion of the froth layer, depositing at least a portion of the froth layer onto a launder, decanting at least a portion of the froth layer, or any combination thereof.

In embodiments, the method further comprises grinding a phosphate mineral ore to provide a ground phosphate ore. In embodiments, the grinding reduces the largest dimension of the raw mineral ore by a factor of 2 to a factor of $1\times10^9$.

In embodiments, the method further comprises combining at least a portion of the ground phosphate ore with at least a portion of the liquid medium to provide a medium-ore slurry. In some such embodiments, the collector is combined with the ground phosphate ore before the ground phosphate ore is added to the at least a portion of the liquid medium. In other embodiments, the collector is combined with the medium ore slurry.

In embodiments, the method further comprises adjusting the particle size distribution in the medium-ore slurry by passing the medium-ore slurry through a mesh screen, by hydrocycloning the medium-ore slurry, desliming the medium-ore slurry, or any combination thereof.

In some embodiments, the method further comprises combining the medium-ore slurry, the medium-ore slurry comprising the collector, with the beneficiating agent, and optionally a second portion of the medium to form a sparge composition comprising a comminuted phosphate ore. In other embodiments, the method further comprises combining the medium ore slurry with the collector, the beneficiating agent, and optionally a second portion of the medium to form a sparge composition comprising a comminuted phosphate ore.

In embodiments, there is provided a use of any one of the sparge compositions described herein to refine a phosphate ore using reverse froth flotation and provide a refined phosphate ore. In some such embodiments, the refined phosphate ore is used to produce phosphoric acid. In the phosphoric acid process, a phosphate ore and an acid such as sulfuric acid are combined and react together to produce phosphoric acid. The greater the proportion of gangue in the phosphate ore, the worse scaling problems and the like that can be encountered in the production of the phosphoric acid. Therefore, froth flotation can be used to produce a concentrate comprising a higher percentage of the phosphate than in the raw phosphate ore. In such a froth flotation, the higher the grade and the recovery of phosphate, the less problems that can be encountered in subsequent phosphoric acid manufacturing.

In reverse froth flotation of phosphate ores, increasing the dosage of a fatty acid collector tends to increase the % $P_2O_5$ in the concentrate (% grade) at the expense of % $P_2O_5$ recovery of concentrate. We have found that the same is true of the sulfonated fatty acid and/or sulfonated fatty acid salt collectors, i.e. in reverse froth flotation of phosphate ores, increasing the dosage of a sulfonated fatty acid and/or sulfonated fatty acid salt increases the grade at the expense of recovery. We have also found that increasing the dosage of a hydroxy fatty acid and/or a salt thereof increases the grade of $P_2O_5$ recovered at the expense of % recovery of $P_2O_5$. However, we have found that in the reverse froth flotation of phosphate ores using sparge composition comprising both sulfonated fatty acid and/or sulfonated fatty acid salts with hydroxy fatty acids and/or hydroxy fatty acid salts, better recovery of $P_2O_5$ is obtained at a given $P_2O_5$ grade, irrespective of dosage of collector. This result is unexpected and unpredictable in the light of the grade and recovery results with the sulfonated fatty acids and/or the salts thereof and the hydroxy fatty acids and/or salts thereof individually.

EXAMPLES

For the Examples described herein, a feed to the conditioning-tank of the flotation circuit of a phosphate flotation plant was tapped, and two samples of the feed slurry obtained on two occasions, Sample I and Sample II. The feed slurry had been deslimed before it entered the flotation circuit of the plant. The feed slurry was filtered, dried, and bagged. The phosphate ore was a sedimentary ore comprising apatite, calcite, dolomite, and silicate. Its particle size distribution and composition were measured and are shown in Table 1.

TABLE 1

Particle size distribution (measured according to ASTM C136) and composition of ore samples (measured using X-ray fluorescence)

| | Particle size distribution, % | | | Composition, % | | | | |
|---|---|---|---|---|---|---|---|---|
| Sample | Particles greater than 250 μm | Particles of diameter 38 μm to 250 μm | Particles of less than 38 μm | $P_2O_5$ | MgO | CaO | $SiO_2$ | Loss at 925° C. |
| Sample I | 19.1 | 68.1 | 12.8 | 21.64 | 1.25 | 53.89 | 1.34 | 19.16 |
| Sample II | 20.58 | 71.58 | 7.84 | 22.34 | 0.54 | 57.35 | 0.94 | 15.56 |

In the Examples described herein, reverse flotation tests were conducted in a Denver D-12 Laboratory Flotation Machine. For each test, a 25% by weight slurry of phosphate ore was made by dispersing a sample of the previously dried and bagged phosphate ore in synthetic water. Each slurry was then conditioned by adding collector and/or beneficiating agent or their combination to provide a sparge composition, and the pH of the sparge composition adjusted to 4.3-6.8 by adding sulfuric acid. The slurry was then sparged with air. The gangue comprising calcite and/or dolomite was floated from the slurry and removed as tailings and the concentrated phosphate ore remained in the slurry as concentrate. Both concentrate and tailings were filtered, dried, weighed, and analyzed for $P_2O_5$ content.

Example 1

In this example, collector formulations were made up from deionized water, a collector, a beneficiating agent, or combinations thereof. Sulfonated oleic acid salt, a 50% by weight actives potassium oleate sulfonate (herein, "SOA"), was used as the collector. The SOA comprises a 50% aqueous solution of sulfonated oleic acid potassium salt, the sulfonated oleic acid potassium salt comprising about 38% by weight monomers of sulfonated oleic acid, about 48% of dimers, trimers, and other oligomers of sulfonated oleic acid, and about 13% unsulfonated oleic acids and other fatty acids.

The beneficiating agent consisted of a sodium soap of a fatty acid (sodium ricinoleate; a sodium salt of a C8-C10 fatty acid without hydroxyl groups, "C810"; or sodium oleate, "oleic"), a sodium soap derived from an oil (palm oil, castor oil, coconut oil, corn oil, or linseed oil), or a sodium soap of rosin.

Performance of these formulas were evaluated with flotation tests with ore Sample I at pH 5.0-5.2, as shown in Table 2 and FIG. 1.

TABLE 2

Flotation results with collector formulas of various soaps and sulfonated oleic acid potassium salt, pH 5.0-5.2

| | Collector formula by weight, % | | | Collector formula | Yield, % | | $P_2O_5$ grade, % | | | $P_2O_5$ recovery, % | |
|---|---|---|---|---|---|---|---|---|---|---|---|
| Test | SOA | Soap | Additional water | dosage Kg/t | C | T | C | T | H | C | T |
| 1 | 100 | None | None | 1.5 | 64.01 | 35.99 | 29.90 | 4.50 | 20.76 | 92.20 | 7.80 |
| 2 | 100 | None | None | 2.0 | 56.89 | 43.11 | 32.34 | 5.94 | 20.96 | 87.78 | 12.22 |
| 3 | 50 | 25 ricinoleic acid sodium soap | 25 | 2.0 | 60.98 | 39.02 | 31.75 | 4.18 | 20.99 | 92.23 | 7.77 |
| 4 | 50 | 25 C8-C10 (C810) fatty acid sodium soap | 25 | 2.0 | 61.95 | 38.05 | 30.88 | 4.66 | 20.90 | 91.52 | 8.48 |
| 5 | 50 | 25 rosin sodium soap | 25 | 2.0 | 71.43 | 28.57 | 27.61 | 3.92 | 20.84 | 94.63 | 5.37 |
| 6 | 50 | 25 oleic acid sodium soap | 25 | 2.0 | 55.65 | 44.35 | 31.64 | 7.21 | 20.81 | 84.63 | 15.37 |
| 7 | 50 | 25 castor oil sodium soap | 25 | 2.0 | 60.05 | 39.95 | 32.10 | 4.62 | 21.12 | 91.26 | 8.74 |
| 8 | 50 | 25 coconut oil sodium soap | 25 | 2.0 | 56.92 | 43.08 | 32.80 | 5.49 | 21.03 | 88.75 | 11.25 |
| 9 | 50 | 25 linseed oil sodium soap | 25 | 2.0 | 53.20 | 46.80 | 33.52 | 7.00 | 21.10 | 84.48 | 15.52 |
| 10 | 50 | 25 corn oil sodium soap | 25 | 2.0 | 57.80 | 42.20 | 32.00 | 6.04 | 21.05 | 87.89 | 12.11 |

TABLE 2-continued

Flotation results with collector formulas of various soaps and sulfonated oleic acid potassium salt, pH 5.0-5.2

| | Collector formula by weight, % | | | Collector formula | | | | | | | $P_2O_5$ | |
|---|---|---|---|---|---|---|---|---|---|---|---|---|
| | | | Additional | dosage | Yield, % | | $P_2O_5$ grade, % | | | | recovery, % | |
| Test | SOA | Soap | water | Kg/t | C | T | C | T | H | | C | T |
| 11 | 50 | 25 palm oil sodium soap | 25 | 2.0 | 64.69 | 35.31 | 30.40 | 3.80 | 21.01 | | 93.61 | 6.39 |

C = concentrate,
T = tailings,
H = feed.
*Dosage is amount (in kilograms) of collector formulation per metric ton of phosphate ore.
† SOA is itself a 50% aqueous solution of sulfonated oleic acid potassium salt.

The results of $P_2O_5$ recovery and $P_2O_5$ grade are plotted in FIG. 1. "SOA neat" refers to Tests 1 and 2. "Formula" refers to Tests 3-11.

As can be seen in FIG. 1, both the ricinoleic acid sodium soap (sodium ricinoleate) and the castor oil soap gave the best recovery-grade combination, as indicated by distance from the top right of the graph. A major component of castor oil is ester of ricinoleic acid, and therefore a major component of castor oil sodium soap (saponified castor oil) is sodium ricinoleate.

Example 2

Collector formulas were made by combining SOA (a 50% aqueous solution of sulfonated oleic acid potassium salt) and NaR (a 50% aqueous solution of sodium ricinoleate derived from castor oil) at various ratios, as shown in Table 3. These collector formulas were added to a 25% slurry of phosphate ore at the dosages shown in Table 3, and the resulting reverse flotation yield, $P_2O_5$ grade, and $P_2O_5$ recovery determined with ore Sample I at pH 5.0-5.2. Their flotation performance of each of these formulas is shown in the Table 3 and FIG. 2.

TABLE 3

Flotation results with collector formulas of sodium ricinoleate and sulfonated oleic acid potassium salt, pH 5.0-5.2

| | Collector formula by weight % | | Collector formulation | | | | | | $P_2O_5$ | |
|---|---|---|---|---|---|---|---|---|---|---|
| | SOA | | dosage, | Yield, % | | $P_2O_5$ grade, % | | | recovery, % | |
| Test | collector | NaR | Kg/t | C | T | C | T | H | C | T |
| 1 | 100 | 0 | 1.5 | 64.01 | 35.99 | 29.90 | 4.50 | 20.76 | 92.20 | 7.80 |
| 2 | 100 | 0 | 2.0 | 56.89 | 43.11 | 32.34 | 5.94 | 20.96 | 87.78 | 12.22 |
| 12 | 0 | 100 | 2.0 | 84.32 | 15.68 | 23.90 | 4.67 | 20.88 | 96.49 | 3.51 |
| 13 | 0 | 100 | 3.0 | 78.65 | 21.35 | 25.12 | 5.42 | 20.91 | 94.47 | 5.53 |
| 14 | 30 | 70 | 2.0 | 64.32 | 35.68 | 30.43 | 4.14 | 21.05 | 92.98 | 7.02 |
| 15 | 40 | 60 | 1.5 | 62.88 | 37.12 | 31.35 | 3.87 | 21.15 | 93.21 | 6.79 |
| 16 | 40 | 60 | 2.0 | 60.98 | 39.02 | 31.75 | 4.18 | 20.99 | 92.23 | 7.77 |
| 17 | 40 | 60 | 2.5 | 60.18 | 39.82 | 32.00 | 4.30 | 20.97 | 91.84 | 8.16 |
| 18 | 50 | 50 | 1.5 | 63.07 | 36.93 | 31.00 | 4.04 | 21.04 | 92.91 | 7.09 |
| 19 | 50 | 50 | 2.0 | 60.71 | 39.29 | 31.68 | 4.49 | 21.00 | 91.60 | 8.40 |
| 20 | 50 | 50 | 2.5 | 59.90 | 40.10 | 32.06 | 4.48 | 21.00 | 91.45 | 8.55 |
| 21 | 57 | 43 | 2.0 | 55.53 | 44.47 | 32.86 | 6.21 | 21.01 | 86.86 | 13.14 |

C = concentrate,
T = tailings,
H = feed.
*Dosage is amount (in kilograms) of collector formulation per metric ton of phosphate ore.

Figure 2:
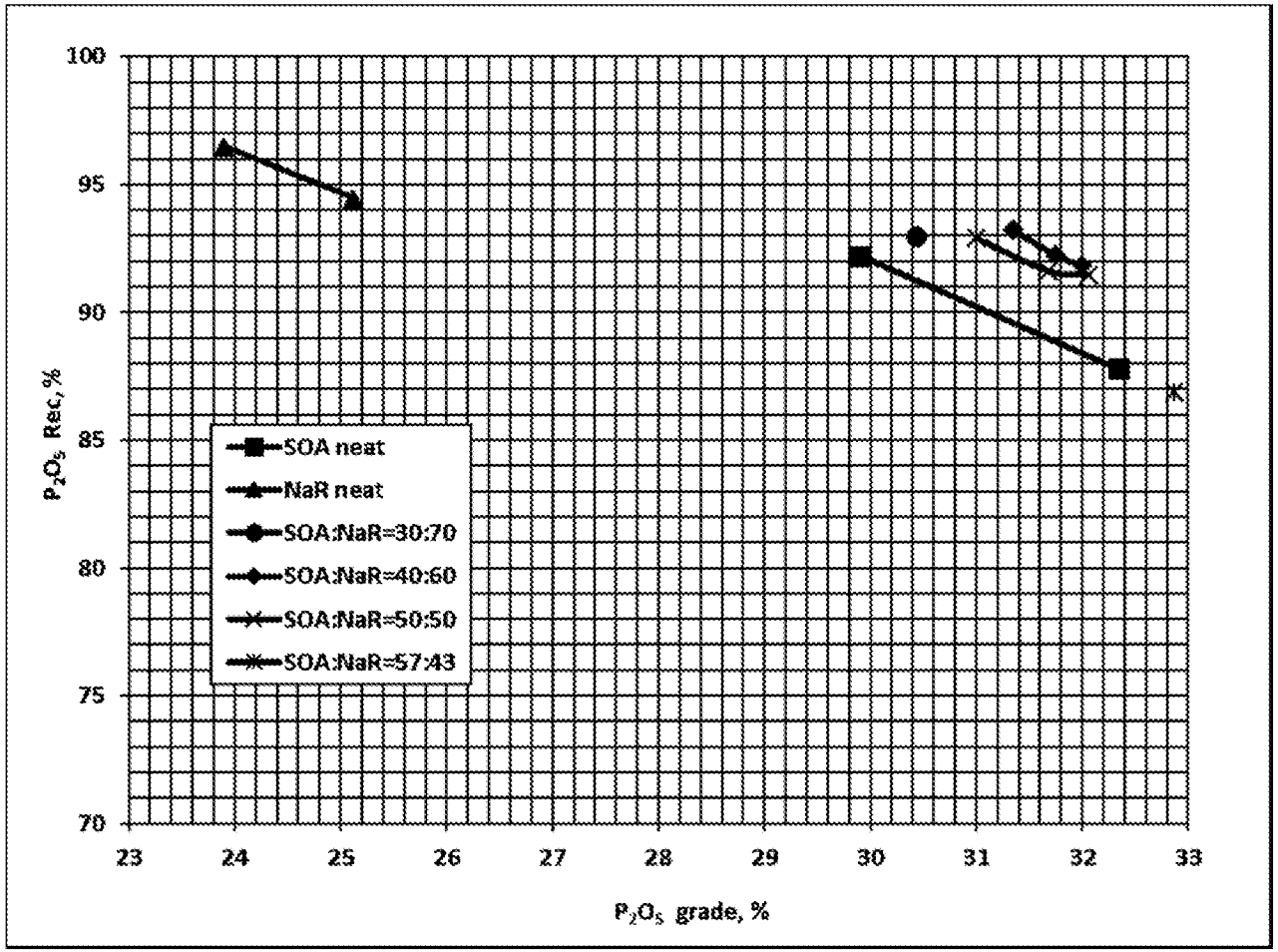
FIG. 2 shows a plot of phosphate recovery versus phosphate grade in the froth flotation of sparge compositions comprising sulfonated oleic acid potassium salt, sodium ricinoleate, and various combinations thereof.

FIG. 2 shows the flotation results with the collector formulas of Table 3. Combinations of SOA and NaR wherein the ratio by weight of sulfonated oleic acid potassium salt to sodium ricinoleate was <1:1 or about 1:1 gave the best combination of $P_2O_5$ recovery and grade. These combinations outperformed both sulfonated oleic acid potassium salt and sodium ricinoleate individually ("neat", Tests 1 and 2). However, at the ratio above 1.3:1 by weight of sulfonated oleic acid potassium salt to sodium ricinoleate, no remarkable improvement in grade-recovery but slightly stronger collectability were observed in comparison to those of sulfonated oleic acid potassium salt absent the hydroxy fatty acid composition.

Example 3

Collector formulas were made by combining SOA, a 50% aqueous solution of sulfonated oleic acid potassium salt, and "S-Castor", an 80% aqueous solution of a sulfonated hydrolyzed castor-oil sodium salt, in which the hydrolyzed castor oil comprised about 20% sulfonated ricinoleic acid sodium salt and about 80% of sodium ricinoleate (unsulfonated). The 25% slurry (pH 5.0-5.2) of the phosphate ore Sample I was dosed with the collector formulas as described in Table 4 to provide sparge compositions, where reverse flotation results using the sparge compositions are reported.

TABLE 4

Flotation results with collector formulas of sulfonated castor oil sodium salt and sulfonated oleic acid potassium salt, pH 5.0-5.2

| | Collector formula by weight, % | | Collector formulation | | | | | | $P_2O_5$ | |
|---|---|---|---|---|---|---|---|---|---|---|
| | SOA | | dosage, | Yield, % | | $P_2O_5$ grade, % | | | recovery, % | |
| Test | collector | S-Castor | Kg/t | C | T | C | T | H | C | T |
| 1 | 100 | 0 | 1.5 | 64.01 | 35.99 | 29.90 | 4.50 | 20.76 | 92.20 | 7.80 |
| 2 | 100 | 0 | 2.0 | 56.89 | 43.11 | 32.34 | 5.94 | 20.96 | 87.78 | 12.22 |
| 22 | 0 | 100 | 2.0 | 68.34 | 31.66 | 27.23 | 6.23 | 20.58 | 90.42 | 9.58 |
| 23 | 0 | 100 | 3.0 | 65.24 | 34.76 | 28.26 | 6.59 | 20.73 | 88.95 | 11.05 |
| 24 | 30 | 70 | 1.5 | 63.2 | 36.80 | 30.76 | 4.35 | 21.04 | 92.39 | 7.61 |
| 25 | 30 | 70 | 2.0 | 60.35 | 39.65 | 31.45 | 4.91 | 20.93 | 90.70 | 9.3 |
| 26 | 30 | 70 | 2.5 | 58.27 | 41.73 | 32.18 | 5.50 | 21.04 | 89.10 | 10.90 |

C = concentrate,
T = tailings,
H = feed.
*Dosage is amount (in kilograms) of collector formulation per metric ton of phosphate ore.

Figure 3:
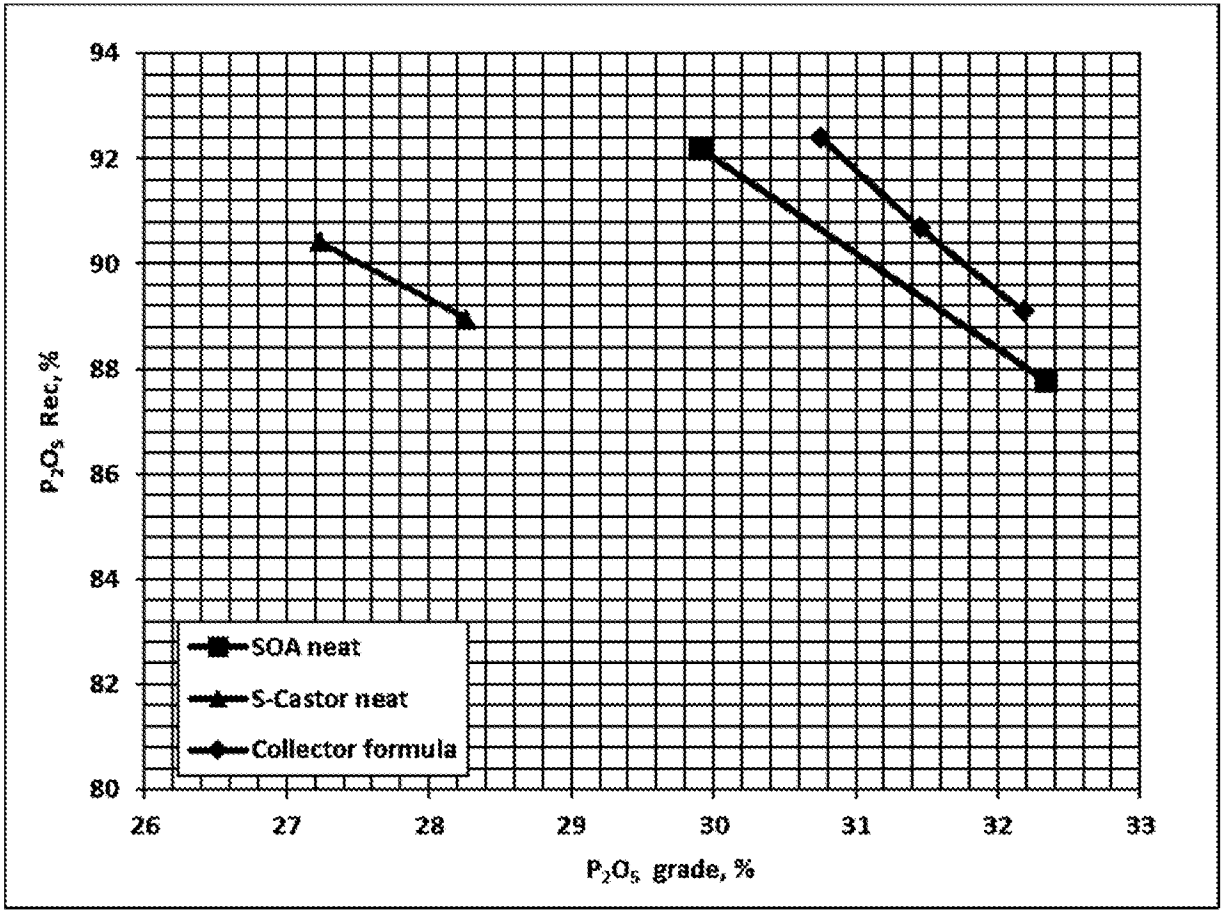
FIG. 3 shows a plot of phosphate recovery versus phosphate grade in the froth flotation of sparge compositions comprising sulfonated oleic acid potassium salt, sulfonated castor soap, and a combination thereof.

Plots of $P_2O_5$ recovery versus $P_2O_5$ grade are shown in FIG. 3. The figure shows that the combination of the SOA (sulfonated oleic acid potassium salt, 50% aqueous solution) and the S-Castor ("Collector formula") outperformed both the SOA and the S-Castor individually ("neat").

Example 4

Sulfonated oleic acid (SOA, a 50% aqueous solution of sulfonated oleic acid potassium salt) and potassium 12-hydroxystearate (H-Stearic) were dosed separately for flotation at pH 5.0-5.2 with ore Sample I in the dosages shown in Table 5. Reverse froth flotation results are shown in Table 5 and plots of $P_2O_5$ recovery versus $P_2O_5$ grade are shown in FIG. 4.

Figure 4:
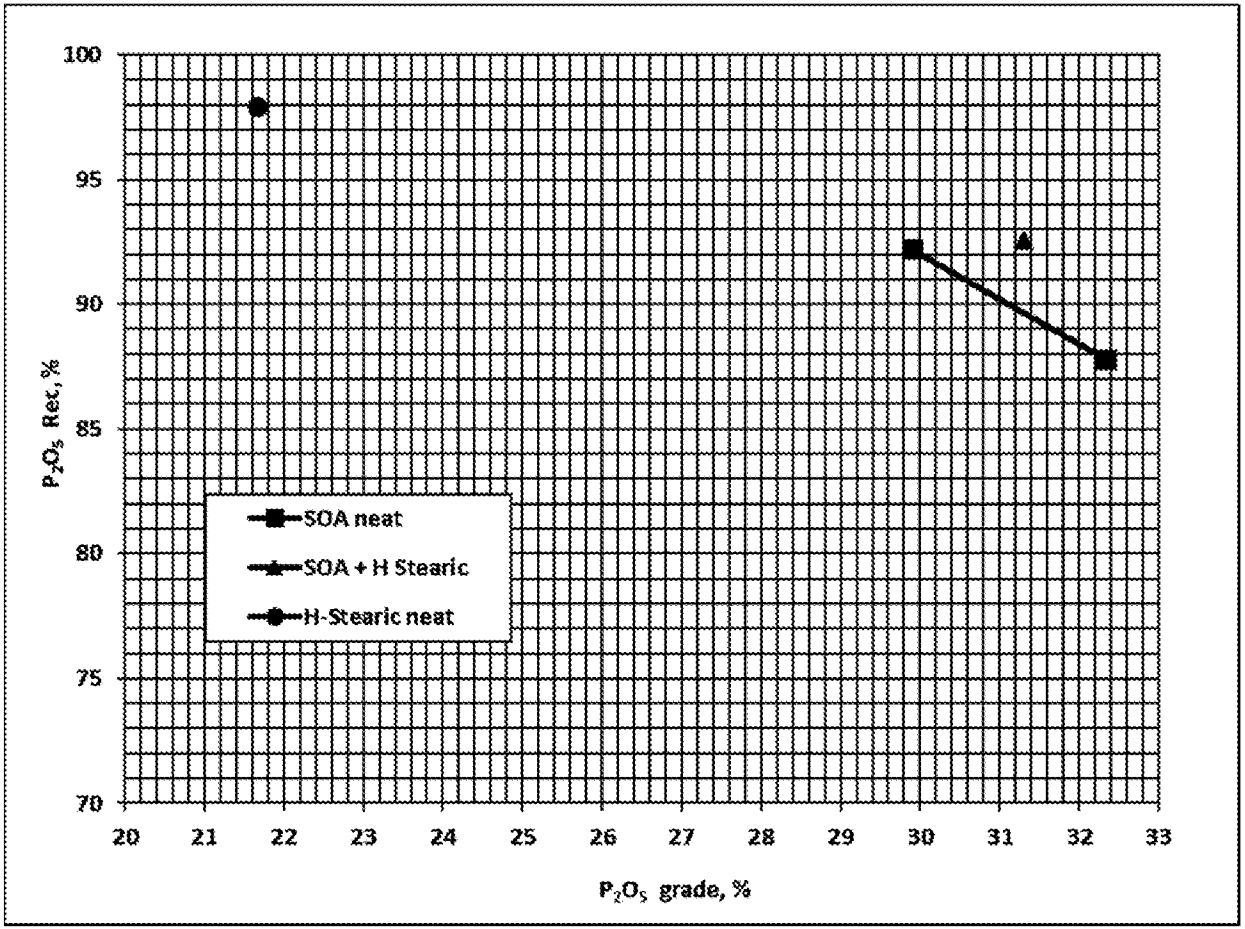
FIG. 4 shows a plot of phosphate recovery versus phosphate grade in the froth flotation of sparge compositions comprising sulfonated oleic acid potassium salt, potassium 12-hydroxystearate, and a combination thereof.

Reverse froth flotation results are shown in Table 5 and plots of $P_2O_5$ recovery versus $P_2O_5$ grade are shown in FIG. 4. The plots shown that the combination of potassium 12-hydroxystearate with the sulfonated oleic acid potassium salt outperformed potassium 12-hydroxystearate ("H-Stearic neat") and the sulfonated oleic acid potassium salt ("SOA neat") individually.

Example 5

Figure 5:
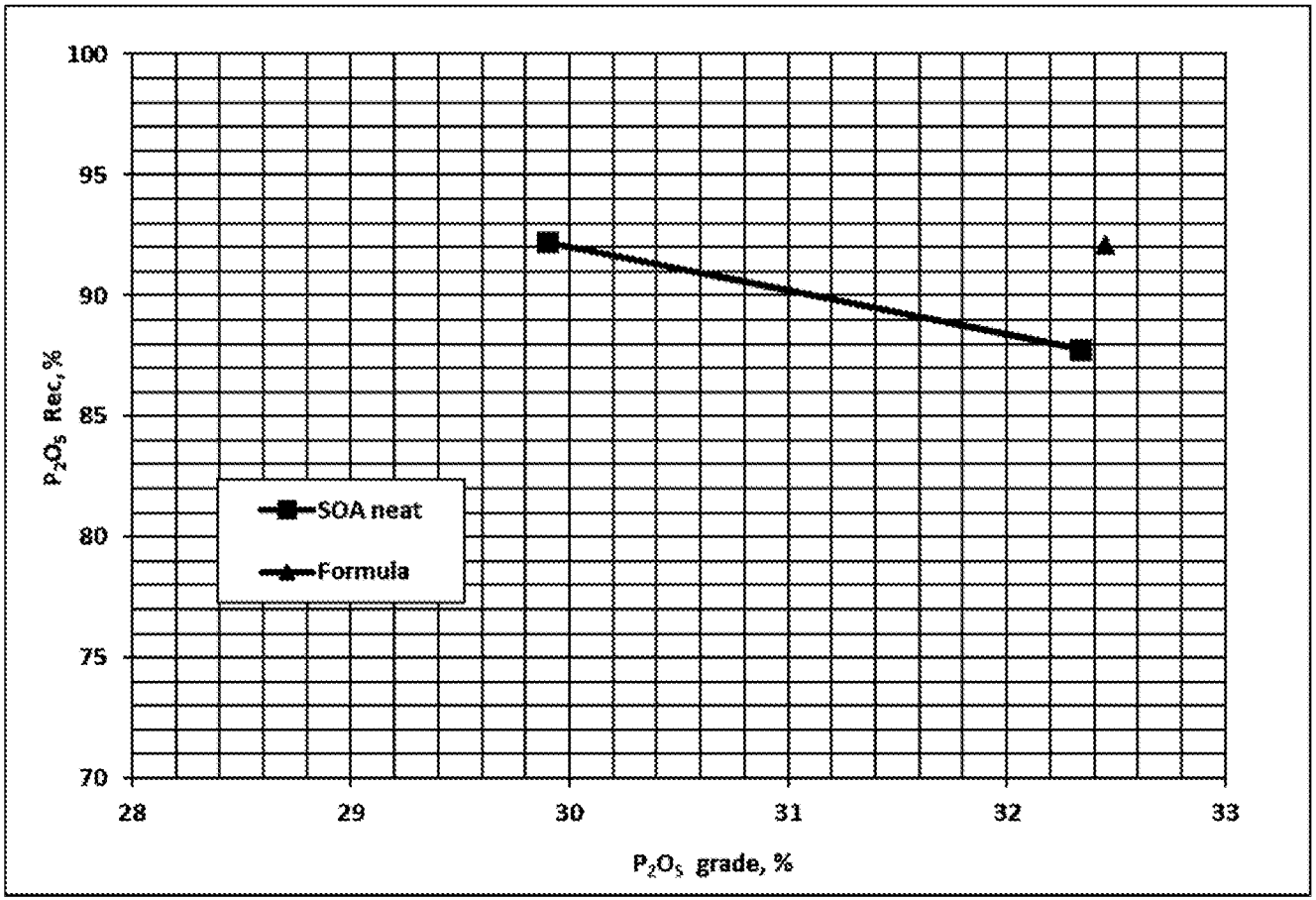
FIG. 5 shows a plot of phosphate recovery versus phosphate grade in the froth flotation of a sparge composition comprising sulfonated oleic acid potassium salt and a sparge composition comprising sulfonated oleic acid potassium salt and a ricinoleic acid salt derived from the hydrolysis of castor oil.

A castor oil potassium soap formula was prepared by the following procedure: 0.1875 parts by weight of castor oil and 0.1875 parts by weight of 22.5 wt % aqueous potassium hydroxide solution were mixed together and heated to 100° C. with mixing for 12 hours. Then the resulting castor oil potassium soap formula was allowed to cool to room temperature. 0.125 parts by weight of water and 0.5 parts by weight of SOA (a 50% by weight aqueous solution of sulfonated oleic acid potassium salt) were added to the castor oil potassium soap formula to provide a collector formula ("Formula"). The Formula was mixed well. The Formula thus made contained 23% ricinoleic acid soap and 25% sulfonated oleic acid. The Formula was used for flotation at pH 5.0-5.2 with ore Sample I at a dosage of 2 kg/t and 32.45% $P_2O_5$ grade and 92.13% recovery were achieved, as shown in Table 6 and FIG. 5.

TABLE 5

Flotation results with potassium 12-hydroxystearate and sulfonated oleic acid potassium salt, pH 5.0-5.2

| | Dosage, Kg/t | | | | | | | $P_2O_5$ | |
|---|---|---|---|---|---|---|---|---|---|
| | SOA | | Yield % | | $P_2O_5$ grade % | | | recovery % | |
| Test # | collector | H-Stearic | C | T | C | T | H | C | T |
| 1 | 1.5 | 0 | 64.01 | 35.99 | 29.9 | 4.5 | 20.76 | 92.2 | 7.8 |
| 2 | 2 | 0 | 56.89 | 43.11 | 32.34 | 5.94 | 20.96 | 87.78 | 12.22 |
| 27 | 1 | 1 | 62.59 | 37.41 | 31.3 | 4.2 | 21.16 | 92.58 | 7.42 |
| 28 | 0 | 2 | 95.47 | 4.53 | 21.66 | 9.61 | 21.11 | 97.94 | 2.06 |

C = concentrate,
T = tailings,
H = feed.
*Dosage is amount (in kilograms) of collector formulation per metric ton of phosphate ore

TABLE 6

Flotation results with collector formulas of ricinoleic salt derived from castor oil and sulfonated oleic acid potassium salt, pH 5.0-5.2

| | Collector | | | | | | | $P_2O_5$ | |
|---|---|---|---|---|---|---|---|---|---|
| | | Dosage, | Yield % | | $P_2O_5$ grade, % | | | recovery, % | |
| Test # | Collector | Kg/t | C | T | C | T | H | C | T |
| 1 | SOA neat | 1.5 | 64.01 | 35.99 | 29.90 | 4.50 | 20.76 | 92.20 | 7.80 |
| 2 | SOA neat | 2.0 | 56.89 | 43.11 | 32.34 | 5.94 | 20.96 | 87.78 | 12.22 |
| 29 | Formula | 2.0 | 60.40 | 39.60 | 32.45 | 4.23 | 21.27 | 92.13 | 7.87 |

C = concentrate,
T = tailings,
H = feed.
*Dosage is amount (in kilograms) of collector formulation per metric ton of phosphate ore.

Example 6

Figure 6:
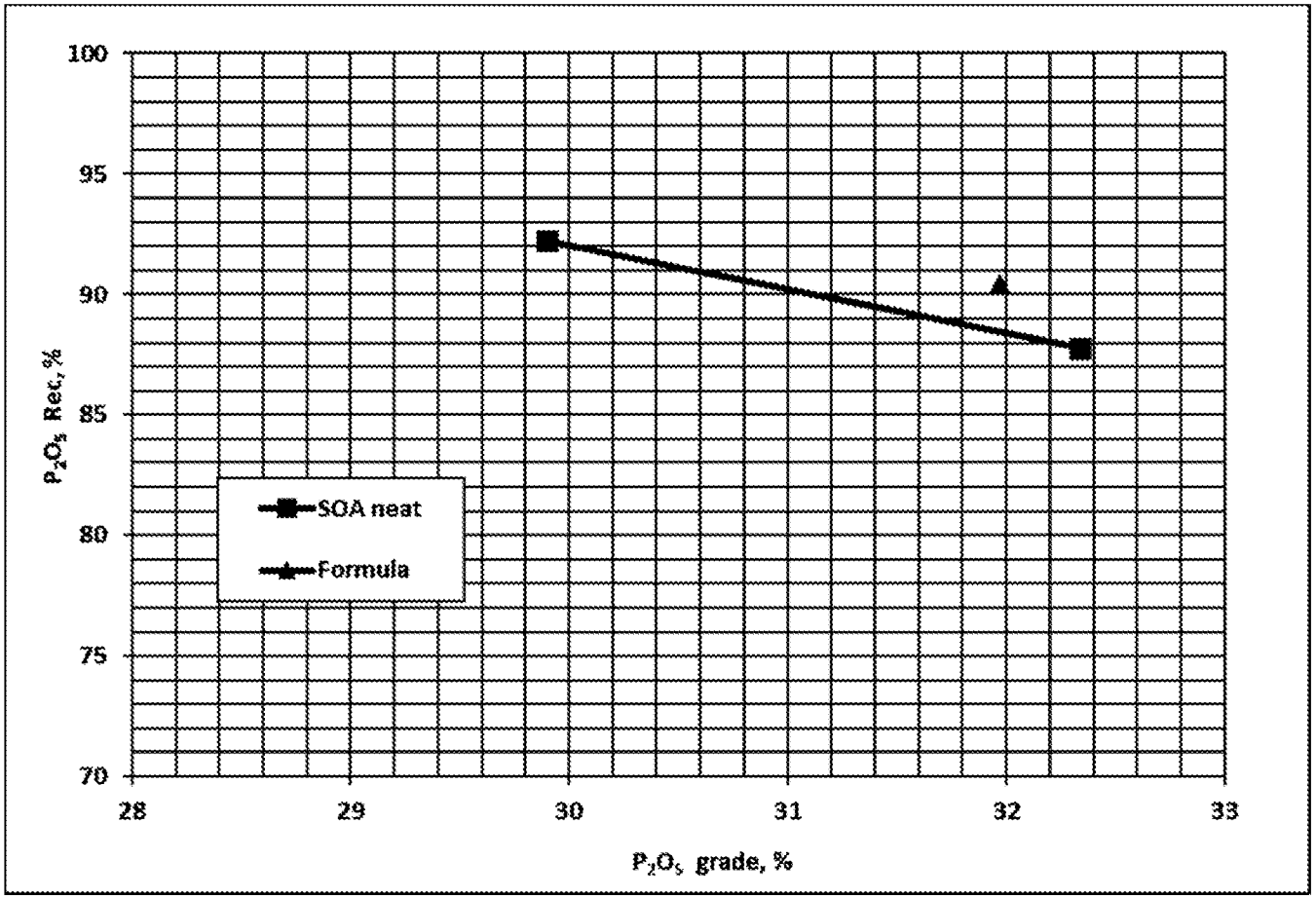
FIG. 6 shows a plot of phosphate recovery versus phosphate grade in the froth flotation of a sparge composition comprising sulfonated oleic acid potassium salt and a sparge composition comprising sulfonated oleic acid potassium salt and a castor oil/corn oil sodium soap formula.

A castor oil/corn oil sodium soap formula was prepared by the following procedure: 0.0625 parts by weight of castor oil, 0.0625 parts by weight of corn oil, and 0.125 parts by weight of 25% aqueous sodium hydroxide solution were mixed together and heated to 100° C., with mixing for 12 hrs. The resulting mixture was allowed to cool to room temperature. 0.25 parts by weight of water and 0.5 parts by weight of SOA (a 50% by weight aqueous solution of sulfonated oleic acid potassium salt) were added to the castor oil/corn oil soap formula to provide a collector formula. The collector formula was mixed well. The resulting collector formula contained 6% ricinoleic acid soap and 25% sulfonated oleic acid. The formula was used for reverse flotation at pH 5.0-5.2 with ore Sample I at a dosage of 2 kg/t and 31.97% $P_2O_5$ grade and 90.42% recovery for the concentrate were achieved, as shown in Table 7 and FIG. 6.

TABLE 7

Flotation results with collector formulas of ricinoleic salt derived from castor oil and sulfonated oleic acid potassium salt at pH 5.0-5.2

| | Collector | | | | | | | $P_2O_5$ | |
|---|---|---|---|---|---|---|---|---|---|
| | | dosage, | Yield, % | | $P_2O_5$ grade, % | | | recovery, % | |
| Test # | Collector | Kg/t | C | T | C | T | H | C | T |
| 1 | SOA neat | 1.5 | 64.01 | 35.99 | 29.90 | 4.50 | 20.76 | 92.20 | 7.80 |
| 2 | SOA neat | 2.0 | 56.89 | 43.11 | 32.34 | 5.94 | 20.96 | 87.78 | 12.22 |
| 29 | Formula | 2.0 | 60.61 | 39.39 | 31.97 | 5.21 | 21.42 | 90.42 | 9.58 |

C = concentrate,
T = tailings,
H = feed.
*Dosage is amount (in kilograms) of collector formulation per metric ton of phosphate ore.

Example 7

Figure 7:
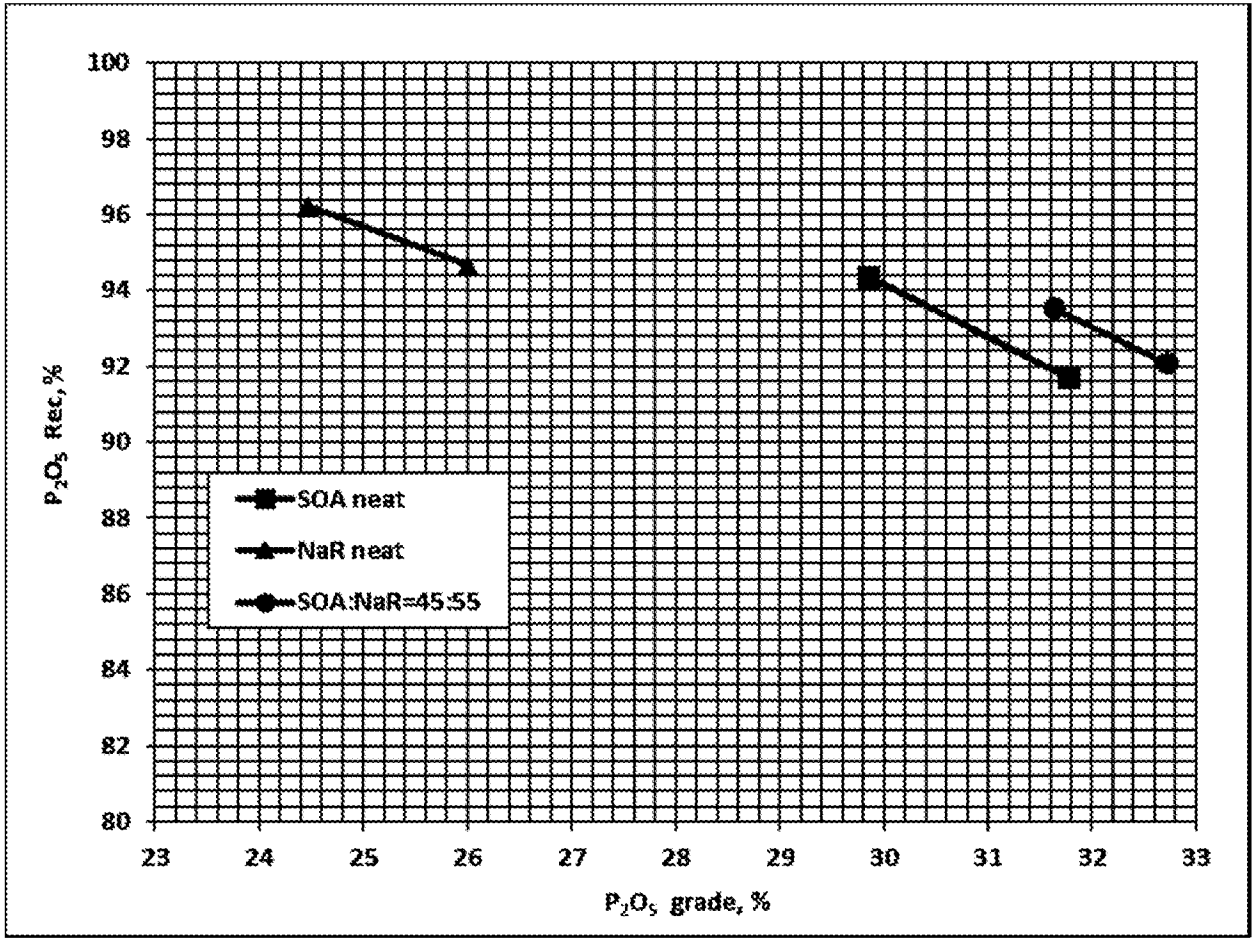
FIG. 7 shows a plot of phosphate recovery versus phosphate grade in the froth flotation of a sparge composition comprising sulfonated oleic acid potassium salt, a sparge composition comprising sodium ricinoleate, and a sparge composition comprising sulfonated oleic acid potassium salt and sodium ricinoleate.

Collector formulas were made by combining 45% SOA (a 50% aqueous solution of sulfonated oleic acid potassium salt) and 55% NaR (a 50% aqueous solution of sodium ricinoleate derived from castor oil). The 25% slurry, pH 4.3-4.7, of the phosphate ore sample II was dosed with the collector formulas as described in Table 8 and FIG. 7 to provide sparge compositions. The reverse flotation results using the sparge compositions are reported in Table 7 and FIG. 7. The results show that the combination of NaR and SOA outperformed both the NaR and the SOA individually ("neat") at pH 4.3-4.7.

TABLE 8

Flotation results with collector formulas of ricinoleic sodium salt and sulfonated oleic acid potassium salt at pH 4.3-4.7

| | Collector formula by weight, % | | Collector formulation dosage, | Yield, % | | $P_2O_5$ grade, % | | | $P_2O_5$ recovery, % | |
|---|---|---|---|---|---|---|---|---|---|---|
| Test # | SOA | NaR | Kg/t | C | T | C | T | H | C | T |
| 30 | 100 | 0 | 1.5 | 70.86 | 29.14 | 29.85 | 4.32 | 22.41 | 94.38 | 5.62 |
| 31 | 100 | 0 | 2.0 | 64.28 | 35.72 | 31.78 | 5.18 | 22.28 | 91.70 | 8.30 |
| 32 | 0 | 100 | 1.5 | 88.91 | 11.09 | 24.47 | 7.72 | 22.61 | 96.21 | 3.79 |
| 33 | 0 | 100 | 2.0 | 81.83 | 18.17 | 26.01 | 6.61 | 22.48 | 94.66 | 5.34 |
| 34 | 45 | 55 | 1.5 | 66.33 | 33.67 | 31.63 | 4.30 | 22.43 | 93.54 | 6.46 |
| 35 | 45 | 55 | 2.0 | 63.94 | 36.06 | 32.71 | 4.98 | 22.71 | 92.09 | 7.91 |

C = concentrate,
T = tailings,
H = feed.
*Dosage is amount (in kilograms) of collector formulation per metric ton of phosphate ore

Example 8

Figure 8:
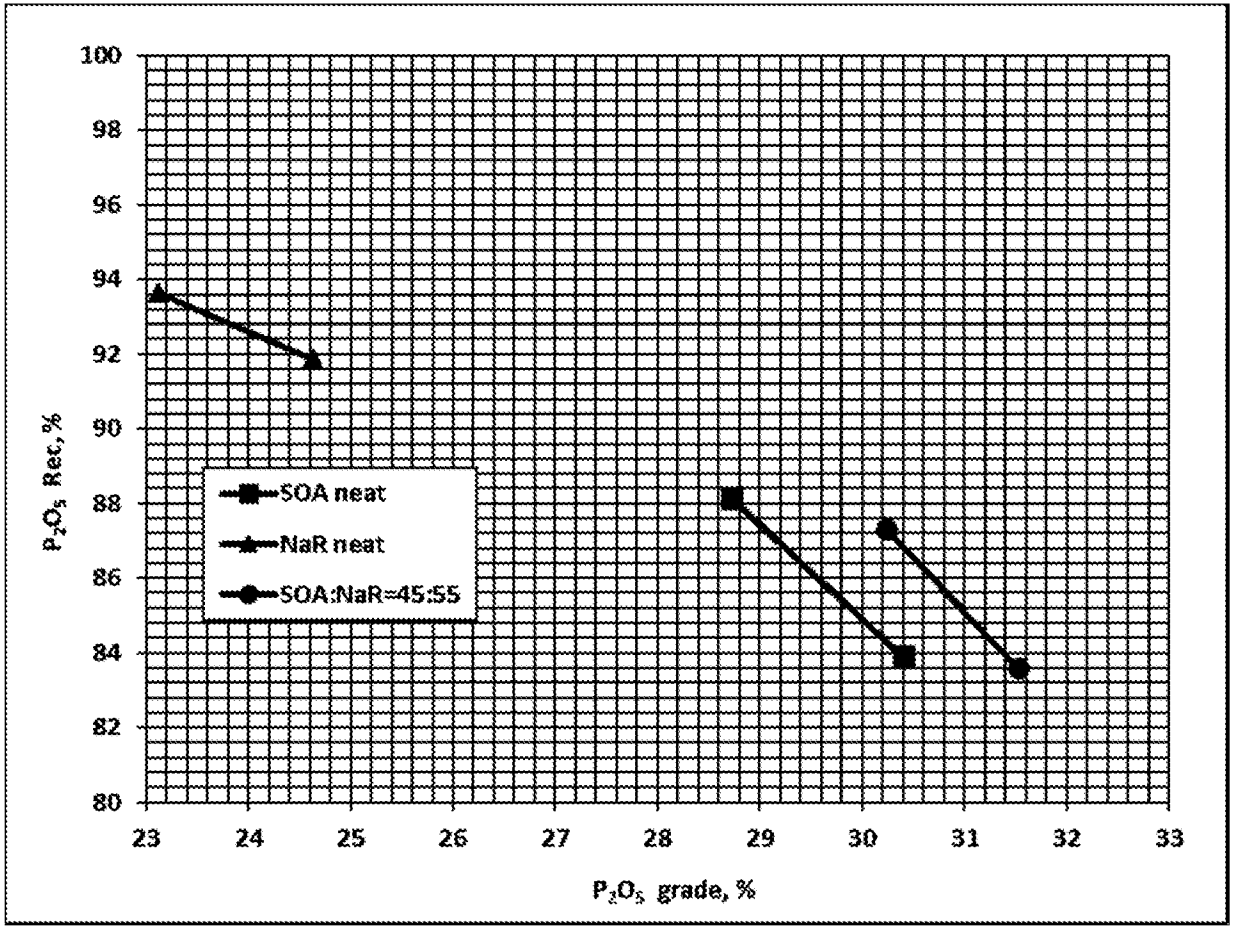
FIG. 8 shows a plot of phosphate recovery versus phosphate grade in the froth flotation of a sparge composition comprising sulfonated oleic acid potassium salt, a sparge composition comprising sodium ricinoleate, and a sparge composition comprising sulfonated oleic acid potassium salt and sodium ricinoleate.

Collector formulas were made by combining 45% SOA (a 50% aqueous solution of sulfonated oleic acid potassium salt) and 55% NAR (a 50% aqueous solution of sodium ricinoleate derived from castor oil). The 25% slurry, pH 6.4-6.8, of the phosphate ore Sample II was dosed with the collector formulas as described in Table 9 to provide sparge compositions. Results are reported in Table 9 and FIG. 8. Reverse flotation results using the sparge compositions are reported. The results show that the combination of NaR and SOA outperformed both the NaR and the SOA individually ("neat") at pH 6.4-6.8.

TABLE 9

Flotation results with collector formulas of ricinoleic sodium salt and sulfonated oleic acid potassium salt at pH 6.4-6.8

| | Collector formula by weight, % | | Collector formula dosage, | Yield, % | | $P_2O_5$ grade, % | | | $P_2O_5$ recovery, % | |
|---|---|---|---|---|---|---|---|---|---|---|
| Test # | SOA | NaR | Kg/t | C | T | C | T | H | C | T |
| 36 | 100 | 0 | 2.5 | 65.79 | 34.21 | 28.73 | 7.45 | 22.41 | 88.12 | 11.88 |
| 37 | 100 | 0 | 3.0 | 59.89 | 40.11 | 30.40 | 8.70 | 22.28 | 83.91 | 16.09 |
| 38 | 0 | 100 | 2.5 | 85.81 | 14.19 | 23.12 | 9.50 | 22.61 | 93.64 | 6.36 |
| 39 | 0 | 100 | 3.0 | 83.34 | 16.66 | 24.63 | 10.89 | 22.48 | 91.88 | 8.12 |
| 40 | 45 | 55 | 2.5 | 63.95 | 36.05 | 30.24 | 7.80 | 22.43 | 87.31 | 12.69 |
| 41 | 45 | 55 | 3.0 | 60.18 | 39.82 | 31.52 | 9.35 | 22.71 | 83.59 | 16.41 |

C = concentrate,
T = tailings,
H = feed.
*Dosage is amount (in kilograms) of collector formulation per metric ton of phosphate ore

What is claimed is:

1. A sparge composition comprising:

(i) a medium comprising water;

(ii) a phosphate ore comprising a phosphate beneficiary and a gangue;

(iii) a collector comprising one or more sulfonated fatty acids, one or more sulfonated fatty acid salts, or any combination thereof; and (iv) a beneficiating agent comprising one or more hydroxy fatty acids, one or more hydroxy fatty acid salts, or any combination thereof.

2. The sparge composition of claim 1, wherein the beneficiating agent comprises ricinoleic acid, a salt of ricinoleic acid, 12-hydroxystearic acid, a salt of 12-hydroxystearic acid, 9,10-dihydroxyoctadecanoic acid, a salt of 9,10-dihydroxyoctadecanoic acid, 9,10,18-trihydroxyoctadecanoic acid, a salt of 9,10,18-trihydroxyoctadecanoic acid, lesquerolic acid, a salt of lesquerolic acid, 15-hydroxyhexadecanoic acid, a salt of 15-hydroxyhexadecanoic acid, isoricinoleic acid, a salt of isoricinoleic acid, densipolic acid, a salt of densipolic acid, 14-hydroxy-eicosa-cis-11-cis-17-dienoic acid, a salt of 14-hydroxy-eicosa-cis-11-cis-17-dienoic acid, 2-hydroxyoleic acid, a salt of 2-hydroxyoleic acid, 2-hydroxylinoleic acid, a salt of 2-hydroxylinoleic acid, 18-hydroxystearic acid, a salt of 18-hydroxylinoleic acid, 15-hydroxylinoleic acid, a salt of 15-hydroxylinoleic acid, or any combination thereof.

3. The sparge composition of claim 1, wherein the beneficiating agent comprises ricinoleic acid, a salt of ricinoleic acid, or a combination thereof.

4. The sparge composition of claim 1, wherein the gangue comprises calcite, dolomite, a silicate, silica, or any combination thereof.

5. The sparge composition of claim 1, wherein the collector comprises sulfonated oleic acid, a sulfonated oleic acid salt, sulfonated linoleic acid, a sulfonated linoleic acid salt, sulfonated linolenic acid, a sulfonated linolenic acid salt, sulfonated ricinoleic acid, a sulfonated ricinoleic acid salt, sulfonated palmitoleic acid, a sulfonated palmitoleic acid salt, sulfonated 11-eicosenoic acid, a sulfonated 11-eicosenoic acid salt, sulfonated erucic acid, a sulfonated erucic acid salt, sulfonated nervonic acid, a sulfonated nervonic acid salt, or any combination thereof.

6. The sparge composition of claim 1, wherein the collector comprises sulfonated oleic acid, a salt of sulfonated oleic acid, or a combination thereof.

7. The sparge composition of claim 1, wherein the phosphate ore comprises an apatite.

8. The sparge composition of claim 7, wherein the apatite is selected from the group consisting of fluorapatite, hydroxylapatite, chlorapatite, or any combination thereof.

9. The sparge composition of claim 1, the sparge composition further comprising one or more emulsifying surfactants, one or more additional collectors, one or more depressants, one or more activators, one or more frothing agents, or any combination thereof.

10. The sparge composition of claim 1, further comprising a pH adjusting agent and having a pH of about 4 to about 7.

11. A method of froth flotation comprising:

sparging a sparge composition to yield a sparged slurry comprising a froth and an underflow, wherein the underflow comprises a concentrate comprising a phosphate beneficiary, the froth comprises tailings comprising a gangue, and the sparge composition comprises (i) a medium comprising water, (ii) a phosphate ore comprising the phosphate beneficiary and the gangue, (iii) a collector comprising one or more sulfonated fatty acids, one or more sulfonated fatty acid salts, or any combination thereof, and (iv) a beneficiating agent comprising one or more hydroxy fatty acids, one or more hydroxy fatty acid salts, or any combination thereof; and separating at least a portion of the concentrate from at least a portion of the tailings.

12. The method of claim 11, wherein the medium consists essentially of water.

13. The method of claim 11, wherein the beneficiating agent comprises ricinoleic acid, a salt of ricinoleic acid, 12-hydroxystearic acid, a salt of 12-hydroxystearic acid, 9,10-dihydroxyoctadecanoic acid, a salt of 9,10-dihydroxyoctadecanoic acid, 9,10,18-trihydroxyoctadecanoic acid, a salt of 9,10,18-trihydroxyoctadecanoic acid, lesquerolic acid, a salt of lesquerolic acid, 15-hydroxyhexadecanoic acid, a salt of 15-hydroxyhexadecanoic acid, isoricinoleic acid, a salt of isoricinoleic acid, densipolic acid, a salt of densipolic acid, 14-hydroxy-eicosa-cis-11-cis-17-dienoic acid, a salt of 14-hydroxy-eicosa-cis-11-cis-17-dienoic acid, 2-hydroxyoleic acid, a salt of 2-hydroxyoleic acid, 2-hydroxylinoleic acid, a salt of 2-hydroxylinoleic acid, 18-hydroxystearic acid, a salt of 18-hydroxylinoleic acid, 15-hydroxylinoleic acid, a salt of 15-hydroxylinoleic acid, or any combination thereof.

14. The method of claim 11, wherein the beneficiating agent comprises ricinoleic acid, a salt of ricinoleic acid, or a combination thereof.

15. The method of claim 11, wherein the gangue comprises calcite, dolomite, a silicate, or any combination thereof.

16. The method of claim 11, wherein the collector comprises sulfonated oleic acid, a sulfonated oleic acid salt, sulfonated linoleic acid, a sulfonated linoleic acid salt, sulfonated linolenic acid, a sulfonated linolenic acid salt, sulfonated ricinoleic acid, a sulfonated ricinoleic acid salt, sulfonated palmitoleic acid, a sulfonated palmitoleic acid salt, sulfonated 11-eicosenoic acid, a sulfonated 11-eicosenoic acid salt, sulfonated erucic acid, a sulfonated erucic acid salt, sulfonated nervonic acid, a sulfonated nervonic acid salt, or any combination thereof.

17. The method of claim 11, wherein the collector comprises sulfonated oleic acid, a sulfonated oleic acid salt, or a combination thereof.

18. The method of claim 11, wherein the phosphate ore comprises an apatite.

19. The method claim 11, further comprising: grinding a phosphate mineral ore to provide the phosphate ore.

20. The method of claim 11, wherein the sparge composition further comprises a pH adjusting agent and has a pH of about 4 to about 7.

* * * * *